US007684716B2

(12) United States Patent
Ushiro

(10) Patent No.: US 7,684,716 B2
(45) Date of Patent: Mar. 23, 2010

(54) IMAGE FORMING APPARATUS WITH MAGNETIC FLUX DETECTION

(75) Inventor: Takahiro Ushiro, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 317 days.

(21) Appl. No.: 11/757,745

(22) Filed: Jun. 4, 2007

(65) Prior Publication Data

US 2008/0002996 A1 Jan. 3, 2008

(30) Foreign Application Priority Data

Jun. 8, 2006 (JP) ..... 2006-159653

(51) Int. Cl.
*G03G 15/20* (2006.01)
*H05B 6/14* (2006.01)

(52) U.S. Cl. ..... 399/33; 219/619; 399/328; 399/330

(58) Field of Classification Search ..... 219/619; 399/33, 67, 69
See application file for complete search history.

(56) References Cited

U.S. PATENT DOCUMENTS 6,449,457 B2 9/2002 Samei et al.
6,591,082 B2 7/2003 Samei et al.
6,792,238 B2 9/2004 Samei et al.
6,987,251 B2 * 1/2006 Fukushi et al. ..... 219/619
7,053,345 B2 5/2006 Fukushi et al.
2005/0173416 A1 8/2005 Fukushi et al.

FOREIGN PATENT DOCUMENTS

JP 11-344898 12/1999
JP 2001-242732 9/2001
JP 2002-287542 10/2002
JP 2005-209644 8/2005

* cited by examiner

*Primary Examiner*—Hoang Ngo
(74) *Attorney, Agent, or Firm*—Fitzpatrick, Cella, Harper & Scinto

(57) ABSTRACT

An image heating apparatus includes a coil for generating a magnetic flux; an endless belt having an electroconductive layer for generating heat by the magnetic flux of the coil wherein a recording material carrying image is heated by heat of the belt; a magnetic flux detecting means disposed opposed to the coil with the belt interposed therebetween and capable of detecting the magnetic flux from the coil, the magnetic flux detecting means including a detection portion capable of detecting such a part of the magnetic flux of the magnetic flux generated by the coil as is from a region corresponding to not less than one half of a heat generating region of the belt with respect to a widthwise direction of the recording material; and prohibition means for prohibiting electric power supply to the coil when an amount of the magnetic flux detected by the magnetic flux detecting means reaches a predetermined amount.

4 Claims, 16 Drawing Sheets

| ELEMENTS | CONSTANTS | UNITS |
|---|---|---|
| 27 | 1 | μF |
| 29 | 0.15 | μF |
| 32 | 220 | kΩ |
| 33 | 220 | kΩ |
| 34 | 22 | kΩ |
| 36 | 47 | kΩ |
| 37 | 10 | kΩ |
| 38 | 10 | kΩ |
| 40 | 47 | kΩ |

| | | CONDITION 1 | CONDITION 2 | CONDITION 3 |
|---|---|---|---|---|
| CONDITIONS | BELT 2 | ALL(FIGS.2-4) | HALF(FIG.11) | EITHER |
| | CONNECTOR 17 | NORMAL | NORMAL | DISCONNECTION |
| SIGNALS | Sig1(=V1) | DC 3.3V(FIG.6) | DC 3.3V+AC OF 1V AMP.(FIG.12) | 0V |
| | V2 | 0V(FIG.10) | 1V(FIG.13) | 0V |
| | Sig2 | LOW LVL | HI LVL | LOW LVL |
| | Sig3 | LOW LVL | LOW LVL | HI LVL |
| | Sig4 | HI LVL | LOW LVL | LOW LVL |
| COIL DRIVE | | DRIVABLE BY TEMP. CONTROLLER | STOP | STOP |

FIG.8

IMAGE FORMING APPARATUS WITH MAGNETIC FLUX DETECTION

FIELD OF THE INVENTION AND RELATED ART

The present invention relates to an image heating apparatus which heats the image on recording medium.

As examples of an image heating apparatus, there may be listed a fixing apparatus, a glossiness increasing apparatus, and so on. A fixing apparatus is an apparatus which permanently fixes the unfixed image on recording medium, to the recording medium. A glossiness increasing apparatus is an apparatus which increases in glossiness the fixed image on recording medium by heating the fixed image.

There have been proposed various fixing apparatuses for an image forming apparatus, such as an electrophotographic copying machine and an electrophotographic printer. These fixing apparatuses are for permanently fixing (welding) the unfixed toner image borne on recording medium, to the recording medium with the use of heat.

One of these fixing apparatuses is disclosed in Japanese Laid-open Patent Application 2001-242732. This fixing apparatus employs a fixation belt. This fixation belt is an endless belt, the substrate layer of which is formed of magnetic metal. It is flexible and circularly rotated. The fixing apparatus also has an induction coil for generating heat in the substrate of the fixation belt, and a pressure applying means which presses on the belt to form a nip. The fixing apparatus is structured so that a recording medium on which an image is borne is heated by the heat from the belt while the recording medium is conveyed through the nip. The heat which heats the belt is Joule heat. That is, an alternating magnetic field is generated by flowing high frequency electric current flowed through the induction coil so that Joule heat is generated by the eddy current generated in the metallic substrate layer of the belt by the alternating magnetic field.

The temperature of the belt is controlled by controlling the amount of electric power supplied to the induction coil so that the belt temperature detected by a temperature sensor remains at a preset level.

As the temperature sensor, an electrically resistive member (thermistor), the electric resistance of which is inversely proportional to temperature, is employed. Thus, if this electrically resistive member becomes disconnected from the control circuit, the control circuit determines that the temperature of the belt is low; it reaches an erroneous decision. Consequently, the belt will be continuously heated. One of the solutions to this problem is disclosed in Japanese Laid-open Patent Application 11-344898, for example. According to this patent application, the connector of the electrically resistive member is provided with two additional pins. The two pins are connected to each other with an electrical wire, and it is detected whether or not there is a flow of electric current between the two pins. In other words, if the connector is not in connection with the control circuit, no current is detected between the two pins. Thus, when it is detected that there is no current between the two pins, the power supply to the induction coil is interrupted.

Japanese Laid-open Patent Application 2005-209644 discloses another solution to the abovementioned problem. This patent application relates to a heating apparatus, which is based on electromagnetic induction. The heating apparatus employs a fixation roller, which is heated by electromagnetic induction, and of which Curie point is roughly equal to the fixation temperature. According to this application, the heating apparatus is designed so that whether or not a paper jam has occurred because a sheet of recording medium has wrapped round the fixation roller is determined based on the signals outputted by the means for detecting the temperature of the fixing roller, and the signals from the means for detecting the leakage of the magnetic flux (means for detecting whether or not fixation roller temperature has reached Curie point).

As the flexible and endless fixation belt (metallic belt), which is heated by electromagnetic induction and is circularly moved, increases in cumulative length of usage, it sometimes partially breaks. Obviously, if the flexible belt partially breaks, it becomes impossible to uniformly fix a toner image. In some printing jobs, as many as 1,000 copies must be made. Thus, if the fixation belt becomes damaged immediately before, or immediately after, the start of such a job, it is possible that a very large number of unsatisfactory copies will be outputted; there will be a large amount of waste.

In the case of the structural arrangement disclosed in Japanese Laid-open Patent Application 2005-209644, the phenomenon that magnetic flux leaks as the temperature of the fixation roller exceeds Curie point, is used to simply detect and report the occurrence of the paper jam which occurs as recording medium wraps around the fixation roller which is heated by magnetic induction. That is, the structural arrangement does not detect the abovementioned damage to the belt. Further, the means for detecting the abovementioned magnetic flux leak from the fixation roller to determine whether or not the temperature of the fixation roller has exceeded Curie point of the fixation roller, faces only a part of the fixation roller. Therefore, the structural arrangement disclosed in Japanese Laid-open Patent Application 2005-209644 cannot detect the breakage which has occurred to the areas of the fixation belt, which do not face the means for detecting the magnetic flux leakage.

SUMMARY OF THE INVENTION

Thus, the primary object of the present invention is to prevent the occurrence of waste attributable to belt breakage, by detecting the belt breakage in a timely manner.

According to an aspect of the present invention, there is provided an image heating apparatus comprising a coil for generating a magnetic flux; an endless belt having an electroconductive layer for generating heat by the magnetic flux of said coil wherein a recording material carrying image is heated by heat of said belt; a magnetic flux detecting means disposed opposed to said coil with said belt interposed therebetween and capable of detecting the magnetic flux from said coil, said magnetic flux detecting means including a detection portion capable of detecting such a part of the magnetic flux of the magnetic flux generated by said coil as is from a region corresponding to not less than one half of a heat generating region of said belt with respect to a widthwise direction of the recording material; and prohibition means for prohibiting electric power supply to said coil when an amount of the magnetic flux detected by said magnetic flux detecting means reaches a predetermined amount.

These and other objects, features, and advantages of the present invention will become more apparent upon consideration of the following description of the preferred embodiments of the present invention, taken in conjunction with the accompanying drawings.

BRIEF DESCRIPTION OF THE DRAWINGS

FIG. 8 is a table showing the details of the various conditions of the fixation belt.

DETAILED DESCRIPTION OF THE PREFERRED EMBODIMENTS

Embodiment 1

(Image Forming Portion)

Figure 1:
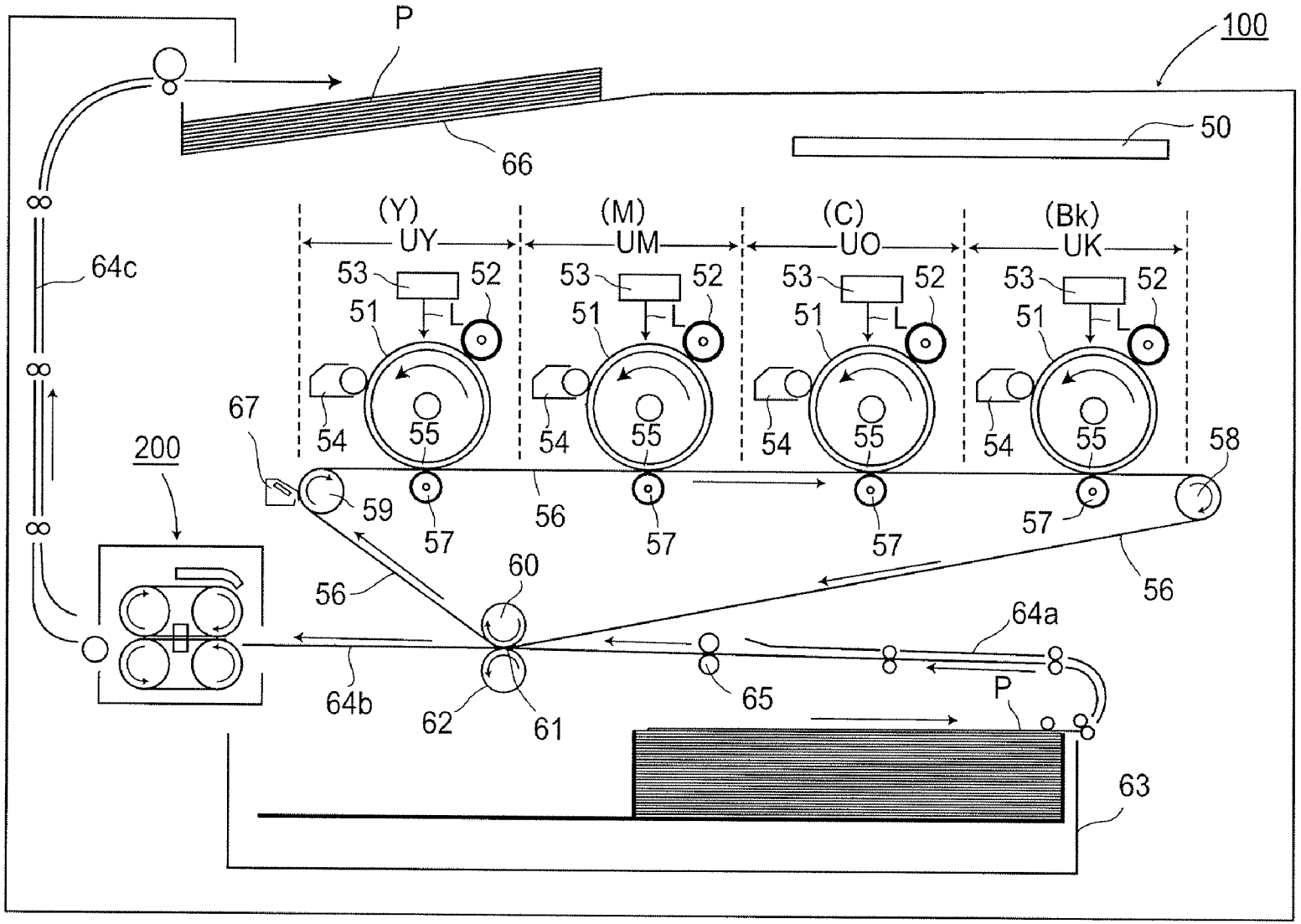
FIG. 1 is a schematic sectional view of the image forming apparatus in the first embodiment of the present invention, showing the general structure of the apparatus.

FIG. 1 is a schematic sectional view of the image forming apparatus 100 having a fixing apparatus 200, which is an image heating apparatus, in accordance with the present invention, based on electromagnetic induction. This image forming apparatus 100 is an electrophotographic full-color printer. First, the general structure of the image forming portion of the apparatus will be described.

Designated by referential characters UY (yellow), UM (magenta), UC (cyan), and UK (black) are first-fourth image formation units, respectively, which are arranged in tandem, in the left to right direction of FIG. 1. Each image formation unit constitutes an electrophotographic image forming system which employs a laser-based exposing method. The four image formation units are identical in structure.

More specifically, in each of the four image formation units UY, UM, UC, and UK, designated by a referential number 51 is an electrophotographic photosensitive member which is in the form of a drum (which hereafter may be referred to as drum), and is rotationally driven in the counterclockwise direction indicated by an arrow mark. Designated by a referential number 52 is a primary charge roller, which uniformly charges the peripheral surface of the drum 51 to preset polarity and potential level. Designated by a referential number 53 is a laser-based exposing unit, which forms an electrostatic latent image by scanning the uniformly charged peripheral surface of the drum 51 with a beam of laser light L which the exposing unit 53 emits while modulating the beam of laser light L with picture signals obtained by separating the optical image of an original (or intended image) into the monochromatic optical images of a primary color. Designated by a referential number 54 is a developing device, which develops the electrostatic latent image on the peripheral surface of the drum 51, into a visible image, that is, an image formed of toner. The developing device 54 of the first image formation unit UY contains yellow toner as developer. The developing device 54 of the second image formation unit UM contains magenta toner as developer. The developing device 54 of the third image formation unit UC contains cyan toner as developer. The developing device 54 of the fourth image formation unit UK contains black toner as developer.

To the control circuit portion 50 (control chip), a print start signal and color separation picture signals of full-color image information are sent out from an external host apparatus (unshown), such as a personal computer, an image reader, a facsimile, and so on. Based on these picture signals, the first image formation unit UY is controlled by the control circuit portion 50 so that a yellow toner image is formed on the peripheral surface of the drum 51 with preset control timing. The second image formation unit UM is controlled by the control circuit portion 50 so that a magenta toner image is formed on the peripheral surface of the drum 51. The third image formation unit UC is controlled by the control circuit portion 50 so that a magenta toner image is formed on the peripheral surface of the drum 51. The fourth image formation unit UB is controlled by the control circuit portion 50 so that a black toner image is formed on the peripheral surface of the drum 51.

The abovementioned toner images on the peripheral surfaces of the drums 51 of the image formation units are sequentially transferred in layers onto the surface of an endless and flexible intermediary transfer belt 56 (which hereafter will be referred to as belt) as an intermediary transferring means, in a primary transfer portion 55, while the belt 56 is circularly driven. As a result, the four unfixed monochromatic toner images are laid in layers on the belt 56, effecting (synthesizing) an unfixed full-color toner image on the belt 56. The toner which failed to be transferred onto the belt 56, that is, the toner remaining on the peripheral surface of the drum 51, in each of the image forming units is recovered into the developing device 54 at the same time as an electrostatic latent image is developed, and is reused for development.

The belt 56 is stretched around, being thereby suspended by, a driving roller 58, a follower roller 59 which also serves as a tension roller, a backup roller 60 for backing up the belt 56 against the pressure from a secondary transfer roller 62. The belt 56 is circularly driven in the clockwise direction indicated by an arrow mark at roughly the same velocity as the peripheral velocity of the drum 51. The belt 56 is positioned so that the portions of the belt 56, which are in the range between the driving roller 58 and follower roller 59, are placed in contact, or virtually in contact, with the bottom portion of the drum 54 of each image formation unit, to form a primary transfer portion 55. Designated by a referential number 57 is a primary transfer roller. There are four primary transfer rollers 57, which are disposed in the primary transfer portions 55, one for one, being on the back surface side of the belt 56, that is, the inward side of the belt loop. During the primary transfer of a toner image, a preset primary transfer bias voltage, which is opposite in polarity to the toner charge, is applied to the primary transfer roller 57.

The unfixed full-color toner image, that is, a synthesized full-color image, on the belt 56 is delivered to the second transfer portion 61 by the subsequent rotation of the belt 56. The second transfer portion 61 is formed by causing the secondary transfer roller 62 to press against the belt backup roller 60 with the belt 56 sandwiched between the two rollers 60 and 62. In other words, the secondary transfer portion 61 is the nip formed between the second transfer roller 61 and belt backup roller 60. To this second transfer portion 61, a sheet of recording medium P (transfer medium) is delivered from a sheet feeding unit 63 with preset control timing, and is conveyed through the second transfer portion 61. As the sheet of recording medium P is conveyed through the second transfer portion 61, the unfixed full-color toner image on the belt 56 is transferred (secondary transfer) onto the surface of the recording medium P as if it were peeled away from the belt 56. During the secondary transfer of the toner image, a preset secondary transfer voltage, which is opposite in polarity to the toner charge, is applied to the second transfer roller 62.

The sheet feeding unit 63 holds multiple sheets of recording medium P, which are vertically stacked in the unit 63. The sheets of recording medium P are fed one by one into the main assembly of the image forming apparatus 100, with preset control timing. After being fed into the main assembly, each recording medium P is conveyed to a pair of registration rollers 65 through a sheet path 64*a*. While the recording medium P is conveyed to the registration rollers 65, the registration rollers 65 remain stationary, causing thereby the leading edge of the recording medium P to collide with the nip which the pair of registration rollers 65 forms. Then, the rotation of the registration rollers 65 is started in coordination with the timing with which each of the image formation units UY, UM, UC, and UB begins to form an image. The timing with which the rotation of the registration rollers 65 is started is such that the point in time at which the leading edge of the recording medium P arrives at the secondary transfer portion 61 coincides with the point in time at which the leading edge of the toner images having been transferred onto the belt 56 from the image formation units arrive at the secondary transfer portion 61.

After the transfer (secondary transfer) of the toner images onto the recording medium P from the surface of the belt 56 in the secondary transfer portion 61, the recording medium P is separated from the surface of the belt 56, and is guided into the fixing apparatus 200 through a sheet path 64*b*. The unfixed toner images on the recording medium P are fixed to the surface of the recording medium P by the heat and pressure applied to the unfixed toner images and recording medium P by the fixing apparatus 200. After being conveyed out of the fixing apparatus 200, the recording medium P is discharged into a delivery tray 66 through a sheet path 64*c*, and is stacked in the delivery tray 66. Incidentally, the image forming apparatus 100 in this embodiment is of the so-called center reference conveyance type, that is, the apparatus 100 is structured so that while a sheet of recording medium (P) is fed into, and conveyed through, the main assembly of the apparatus 100, the center line of the sheet of recording medium remains aligned with the center line of the recording medium passage of the apparatus 100 regardless of the size (width) of the sheet of the recording medium.

Designated by a referential number 67 is a cleaning unit for cleaning the image formation surface of the belt 56. The toner particles which failed to be transfer onto the recording medium P in the secondary transfer portion 61, that is, the toner particles remaining on the belt 56 after the secondary transfer, are removed by the cleaning unit 67.

When the image forming apparatus 100 is in the black-and-white mode, only the fourth image formation unit UK, that is, the image formation unit which forms a black toner image, is activated to output black-and-white copies.

(Fixing Apparatus 200)

Figure 2:
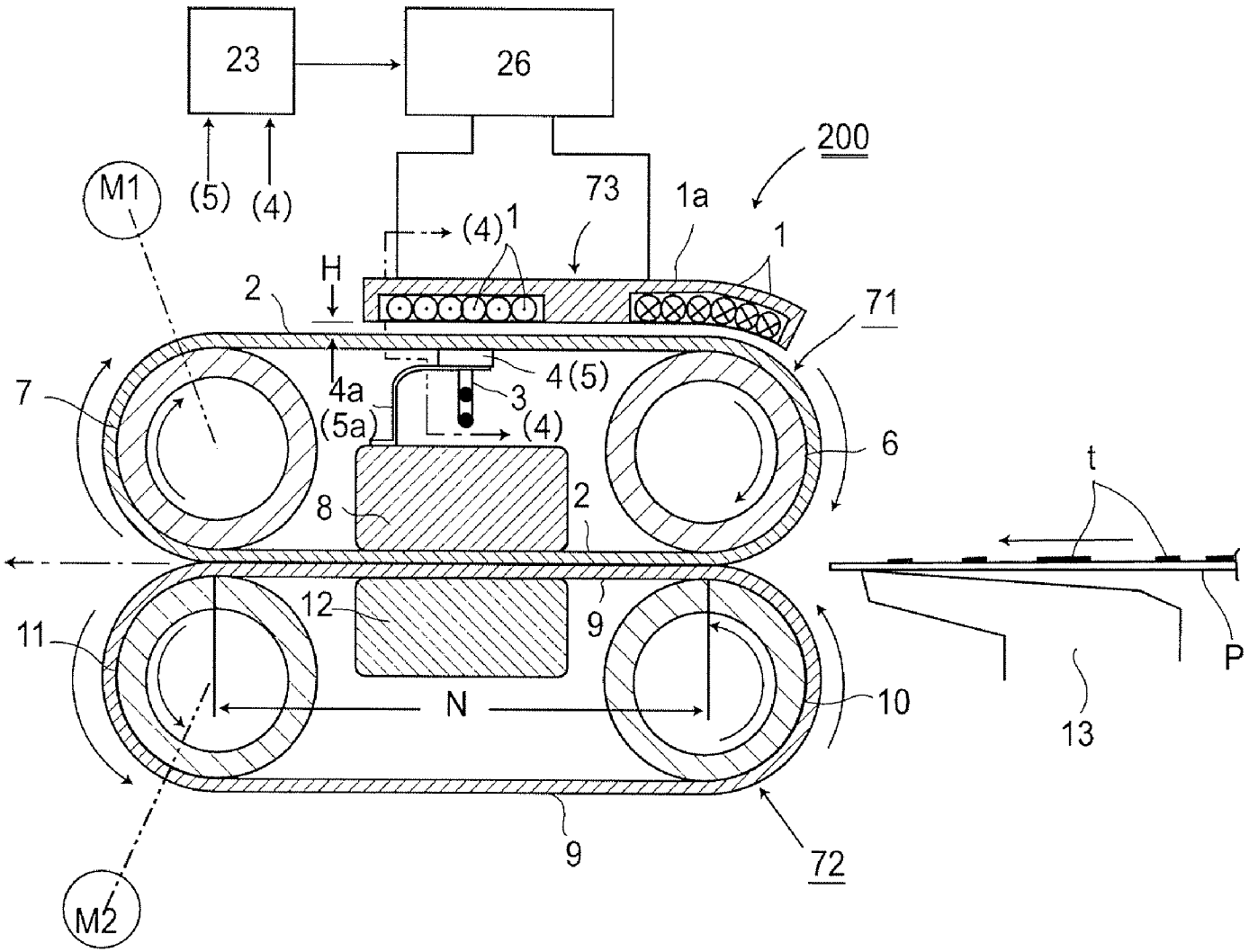
FIG. 2 is an enlarged schematic cross-sectional view of the essential portions of the fixing apparatus.
Figure 3:
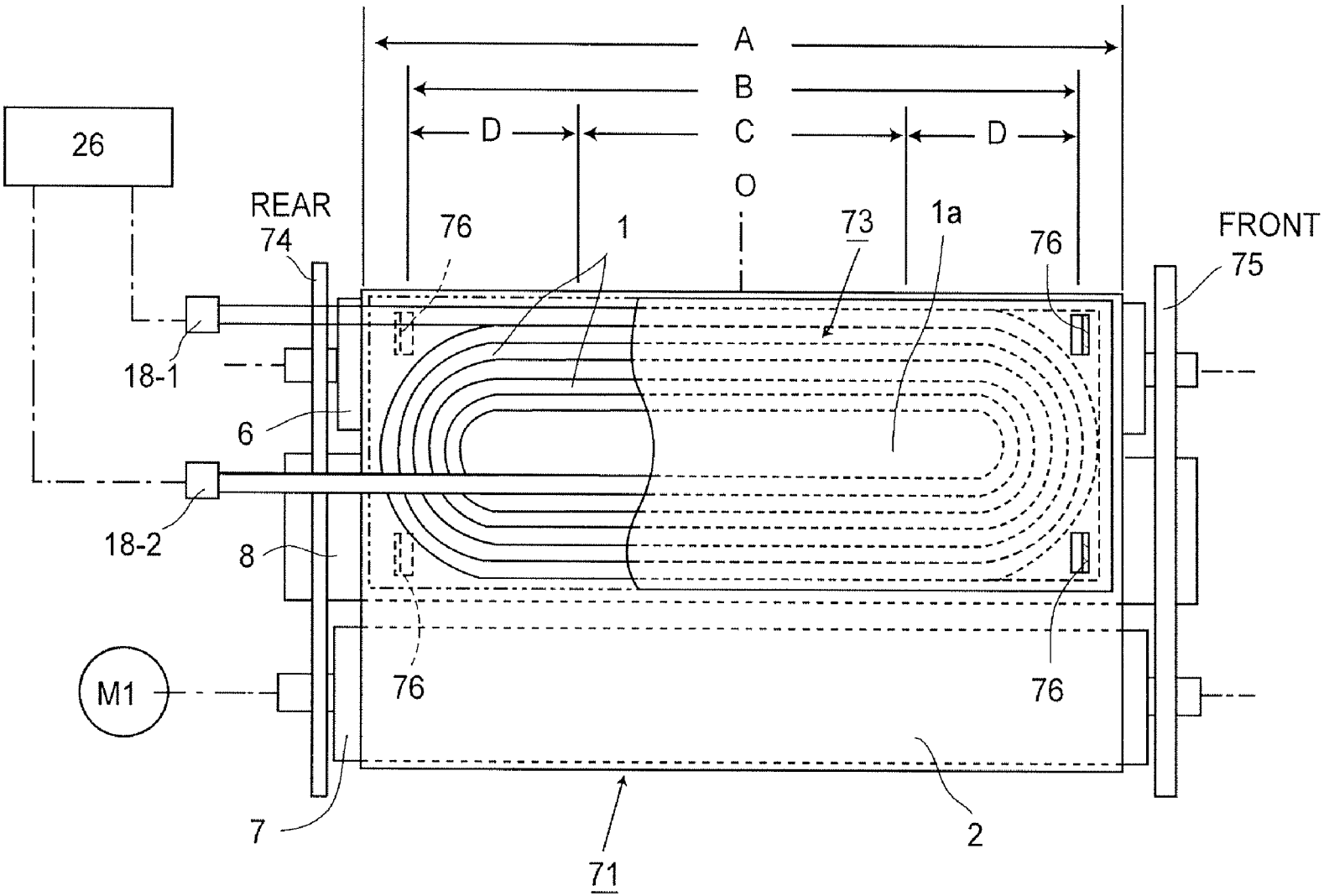
FIG. 3 is a partially cutaway schematic plan view of the fixing apparatus.
Figure 4:
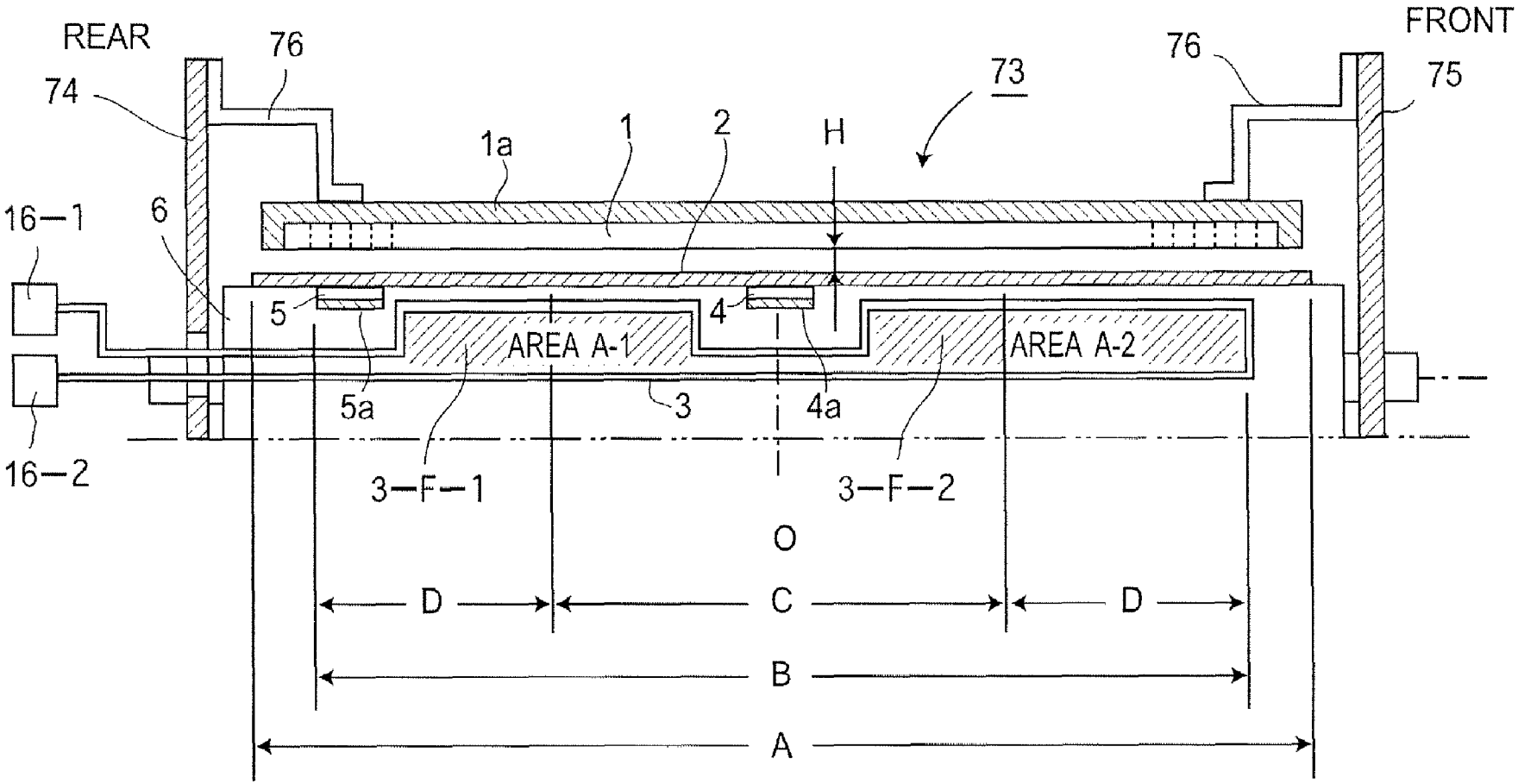
FIG. 4 is a cross-sectional view of the fixing apparatus, along a plane (4)-(4) in FIG. 2.

FIG. 2 is an enlarged schematic cross-sectional view of the essential portions of the fixing apparatus 200 in this embodiment. FIG. 3 is a partially cutaway schematic plan view of the fixing apparatus 200. FIG. 4 is a cross-sectional view of the fixing apparatus 200, along a plane (4)-(4) in FIG. 2. This fixing apparatus 200 is such a fixing apparatus that employs a fixing belt which is heated by electromagnetic induction.

In the following description of the fixing apparatus 200, the upstream and downstream sides are defined with reference to the recording medium conveyance direction.

Designated by referential numbers 71 and 72 are a fixation belt unit and a pressure belt unit (nip formation member), respectively. The fixation belt unit 71 is stacked on top of the pressure belt unit 72. The two units 71 and 72 are kept pressed against each other with the application of a preset amount of pressure so that a fixation nip N is formed between the fixation belt 2 of the fixation belt unit 71 and the pressure belt 9 of the pressure belt unit 72. Designated by a referential number 73 is an induction coil unit as the means for heating the fixation belt 2 by electromagnetic induction. The induction coil unit 73 is on the top side of the fixation belt unit 71.

(1) Fixation Belt Unit 71

Designated by referential numbers 6 and 7 are a pair of rollers of the fixation belt unit 71. The two rollers 6 and 7 constitute the top rollers of the fixation belt unit 71, and are disposed in parallel, with the presence of a present distance, on the upstream (entrance) and downstream (exit) sides, respectively. Designated by a referential number 2 is a fixation belt as a belt to be heated. The fixation belt 2 is supported by the abovementioned two rollers 6 and 7, being stretched between the two rollers. Designated by a referential number 8 is a top pad, which is on the inward side of the fixation belt loop. Each of the top rollers 6 and 7, that is, the top rollers on the entrance and exit sides, respectively, is rotatably supported by the lengthwise ends of its shaft, by the rear and front walls 74 and 75 of the boxy frame of the main assembly of the apparatus, with the placement of a bearing between the shaft and frame. The top pad 8 is nonrotationally held between the rear and front walls of the boxy apparatus frame, by its lengthwise ends, by the rear and front walls 74 and 75 of the apparatus frame. Further, the top roller 6, or the top roller on the entrance side, is made to function as a tension roller. More specifically, it is enabled to move in the direction parallel to the direction in which the fixation belt 2 is kept stretched, and is kept under the pressure generated in the direction to stretch the fixation belt 2. The top roller 7, or the top roller on the exit side, functions as a belt driving roller. It is rotationally driven at a preset velocity in the clockwise direction indicated by an arrow mark, by the rotational driving force which it receives from a motor M1 through a driving force transmitting mechanism (unshown). As the top roller 7 is rotated, the fixation belt 2 and the top roller 6 follow the rotation of the top roller 7; they are rotated by the rotation of the top roller 7, in the clockwise direction indicated by the arrow mark.

The fixation belt 2, in this embodiment, is a flexible endless belt, and has a metallic layer, as a substrate layer, (which is layer in which heat is generated by electromagnetic induction), and a rubber layer. More specifically, the metallic layer is 75 μm thick and is formed of nickel, and the rubber layer is 300 μm thick, and is coated on the outward surface of the metallic layer. The metallic layer (electrically conductive layer) is heated by the eddy current induced in the metallic layer by alternating magnetic field generated by electromagnetic induction.

In FIGS. 3 and 4, designated by a referential character A is the width of the fixation belt 2 (belt dimension in the direction perpendicular to recording medium conveyance direction), and designated by a referential character B is the width of the largest recording medium (in terms of the direction perpendicular to recording medium conveyance direction) conveyable through the fixing apparatus, that is, the width of the recording medium passage of the fixing apparatus. In this embodiment, this width B, or the recording medium passage width, is 279 mm, which is the length of A3 recording paper. The width A of the fixation belt 2 is 370 mm, being wider than 279 mm, that is, the width of the recording medium passage of the fixing apparatus. Designated by a referential character C is the track of a sheet of recording medium, which is narrower than the track of a recording medium of the maximum width, and designated by a referential character D is the width of the area of the recording medium passage, which is outside the track of the recording medium narrower than a recording medium of the maximum width. Designated by a referential character O is a referential line (imaginary line) with which the center line of a recording medium is aligned.

Designated by referential numbers 4 and 5 are main and subordinate thermistors, respectively, as the means for detecting the temperature of the fixation belt 2. The main and subordinate thermistors 4 and 5 are located on the inward side of the fixation belt loop, and are in contact with the inward surface of the fixation belt 2. They are disposed so that they are allowed to perpendicularly move relative to the direction perpendicular to the direction in which the fixation belt 2 is stretched, to remain in contact with the fixation belt 2. They are electrically resistive members, of which resistance value is inversely proportional to their temperature. The main thermistor 4 is in contact with roughly the center portion of the inward surface of the belt portion which is moving through the top side of the belt loop. More specifically, it is attached to the end portion of an elastic plate 4*a*, which is fixed by its base portion to the top pad 8. Thus, the main thermistor 4 is allowed to displace in the direction perpendicular to direction in which the belt is stretched, to remain in contact with the belt 2. In terms of the width direction of the fixation belt 2, the position of the main thermistor 4 roughly corresponds to the center portion of the fixation belt 2, which corresponds to the center portion of the track of a recording medium with the maximum width. As for the subordinate thermistor 5, it is also placed in contact with the inward surface of the belt portion which is moving through the top side of the belt loop. More specifically, it is attached to the end portion of an elastic plate 5*a*, which is fixed by its base portion to the top pad 8. Thus, the subordinate thermistor 5 is allowed to displace in the direction perpendicular to the direction in which the belt 2 is stretched, to remain in contact with the belt 2. In terms of the width direction of the fixation belt 2, the position of the subordinate thermistor 5 corresponds to one of the lateral edges of the recording medium passage, that is, one of the edges of the track of the widest recording medium conveyable through the fixing apparatus 200.

Incidentally, the temperature detecting means 4 and 5 may be disposed close to the fixation belt surface, instead of being placed in contact with the fixation belt surface.

(2) Pressure Belt Unit 72

Designated by referential numbers 10 and 11 are a pair of rollers of the pressure belt unit 72. The two rollers 10 and 11 constitute the bottom rollers of the fixing apparatus 200, and are disposed in parallel, with the presence of a preset distance, on the upstream (entrance) and downstream (exit) sides, respectively. Designated by a referential number 9 is an endless pressure belt. The pressure belt 9 is supported by the abovementioned two rollers 10 and 11, being stretched between the two rollers. Designated by a referential number 12 is a bottom pad, which is on the inward side of the pressure belt loop. Each of the rollers 10 and 11, that is, the bottom rollers on the entrance and exit sides, respectively, is rotatably supported by the lengthwise ends of its shaft, by the rear and front walls 74 and 75 of the boxy frame of the main assembly of the apparatus, with the placement of a bearing between the shaft and frame. The bottom pad 12 is nonrotationally held between the rear and front walls 74 and 75 of the boxy apparatus frame, by its lengthwise ends, by the rear and front walls 74 and 75 of the apparatus frame. Further, the bottom roller 10, or the bottom roller on the entrance side, is made to function as a tension roller. More specifically, it is enabled to move in the direction parallel to the direction in which the pressure belt 9 is kept stretched, and is kept under the pressure generated in the direction to stretch the pressure belt 9. The bottom roller 11, or the bottom roller on the exit side functions as a belt driving roller. It is rotationally driven at a preset velocity in the clockwise direction indicated by an arrow mark in FIG. 2, by the rotational driving force which it receives from a motor M2 through a driving force transmitting mechanism (unshown). As the bottom roller 11 is rotated, the pressure belt 9 and the bottom roller 10 follow the rotation of the bottom roller 11; they are rotated by the rotation of the bottom roller 11, in the clockwise direction indicated by the arrow mark.

The pressure belt 9, in this embodiment, is an entirely flexible endless belt, and has a heat resistant resin layer, as a substrate layer, and a rubber layer. More specifically, the heat resistant resin layer is a 50 μm thick and is formed of polyimide, and the rubber layer is 300 μm thick, and is coated on the outward surface of the heat resistant resin layer. The width of the pressure belt 9 is roughly the same as the width of the fixation belt 2.

The top entrance roller 6 and bottom entrance roller 10 are kept pressed against each other, with the fixation belt 2 and pressure belt 9 pinched between the two rollers, with the application of roughly 196 N (roughly 20 kg) of force. The top pad 8 and bottom pad 12 are kept pressed against each other, with the fixation belt 2 and pressure belt 9 pinched between the two pads, with the application of roughly 392 N (roughly 40 kg) of force. Further, the top exit roller 7 and bottom exit roller 11 are kept pressed against each other, with the fixation belt 2 and pressure belt 9 pinched between the two rollers, with the application of roughly 294 N (roughly 30 kg) of force. With the provision of this structural arrangement, the portion of the fixation belt 2 of the fixation belt unit 71, which corresponds to the bottom side of the fixation belt loop, and the portion of the pressure belt 9 of the pressure belt unit 72, which corresponds to the top side of the pressure belt loop, are kept pressed upon each other, forming thereby the fixation nip N, of which dimension in terms of the recording medium conveyance direction is substantial.

(3) Induction Coil Unit 73

The induction coil unit 73 is located on the opposite side of the fixation belt unit 71 from the pressure belt unit 72. It opposes the outward surface of the fixation belt 2, with the presence of a preset gap H. It is held to the rear and front walls 74 and 75 of the boxy frame of the apparatus, with the use of a bracket 76.

The induction coil unit 73 is provided with an induction coil 1 (which hereafter will be referred to as coil), and a magnetic core 1*a* (which hereafter will be referred to as core). The coil 1 is made up of copper wire, of which surface is coated with, for example, a layer of fusible substance and a layer of electrically insulative substance, and is wound several times. The core 1*a* is formed of a ferric substance, for example. It may be made up of a single plate of a ferric substance, or multiple plates of a ferric substance. More concretely, in this embodiment, Litz wire is used as the electric wire for the coil 1 of the induction coil unit 73. The Litz wire is wound (six turns) in a long (in terms of width direction of fixation belt 2) and flat spiral pattern, and is covered with the core 1*a*. Then, the combination of the coil 1 and core 1*a* are covered with electrically insulative resin, being thereby molded into the induction coil unit 73, which is a long (in terms of width direction of fixation belt 2) and flat member. The core 1*a* covers the entirety of the opposite side of the coil 1 from the fixation belt 2, preventing thereby the magnetic field generated by the coil 1 from propagating in the direction other than toward the metallic (nickel) layer of the fixation belt 2, which is the layer in which heat is generated by electromagnetic induction. The coil 1 is shaped so that its dimension, in terms of the direction perpendicular to the recording medium conveyance direction, is greater than the dimension of the track B of a widest recording medium conveyable through the fixing apparatus 200.

(4) Fixing Operation

As the main power source switch of the image forming apparatus is turned on, or as a print start signal is inputted while the image forming apparatus is on standby, the motors M1 and M2 are driven, whereby the fixation belt 2 and pressure belt 9 are rotationally driven in the clockwise and counterclockwise direction, respectively, at roughly the same velocity. Further, alternating electric current is flowed between the terminals 18-1 and 18-2 of the coil 1 from an induction coil driving circuit 26, generating thereby an alternating magnetic field (magnetic flux). By this alternating magnetic field, heat is generated by electromagnetic induction in the metallic (nickel) substrate layer, as the heat generation layer, of the fixation belt 2. As a result, the fixation belt 2 becomes heated. As the fixation belt 2 becomes heated, the temperature of the fixation belt 2 is detected by the main and subordinate thermistors 4 and 5, and the electrical information regarding the temperature of the fixation belt 2 is inputted from the thermistors 4 and 5 into a temperature control circuit 23 as a controlling means. In this embodiment, the temperature controlling circuit 23 controls the manner in which the coil 1 is driven, so that the temperature level detected by the main thermistor 4 remains at 200° C. More specifically, the temperature control circuit 23 controls the temperature of the fixation belt 2 by control the amount of electric power supplied to the coil 1 from the induction coil heating circuit 26. The temperature of the fixation belt 2 is controlled so that the point of the fixation belt 2, which corresponds to the main thermistor 4, remains at 200° C. However, as this point of fixation belt 2 is moved away from the induction coil unit 7 by the circular rotation of the fixation belt 2, it gradually reduces in temperature. Thus, the temperature of this point of fixation belt 2 will be roughly 180° C. by the time it reaches the interface between the entrance top roller 6 and exit top roller 10, and will be roughly 170° C. by the time it reaches the interface between the top and bottom pads 8 and 12. Further, it will be roughly 160° C. by the time it reaches the interface between the exit top roller 7 and exit bottom roller 11.

As the temperature of the fixation belt 2 reaches the preset fixation temperature, the recording P, on which an unfixed toner image t is borne (has just been formed), is conveyed to the fixing apparatus 200 from the image formation unit side. As the recording medium P reaches the fixing apparatus 200, it is introduced into the fixation nip N, while being guided by a guide 3, with the surface of the recording medium P, on which the toner image t is borne, facing the fixation belt 2. Then, the recording medium P is conveyed through the fixation nip N, with the surface of the recording medium P, on which the toner image t is borne, kept pressed upon the surface of the fixation belt 2. As a result, the unfixed toner image t is fixed to the surface of the recording medium P by heat and pressure, turning into a permanently fixed image. After being conveyed through the fixing apparatus 200, the recording medium P is separated from the surface of the fixation belt 2, and is conveyed further to be discharged from the apparatus.

As a substantial number of small recording mediums P, more specifically, recording mediums P of which dimension in terms of the direction perpendicular to the recording medium conveyance direction is smaller than the width of the track B of the widest recording medium conveyable through the fixing apparatus 200, are consecutively conveyed through the fixing apparatus 200, the area D of the fixation belt 2, that is, the area of the fixation belt 2, which is outside the track of the recording medium P being currently used for image formation, gradually increases in temperature. The subordinate thermistor 5 plays the role of monitoring whether or not the temperature of the area D is excessively high. That is, based on the electrical information regarding the temperature, which is inputted from the subordinate thermistor 5, the temperature control circuit 23 monitors the temperature of the area D. If it determines that the temperature of the area D is excessively high, it executes such a control that is for reducing the temperature of the area D; for example, the control for increasing the recording medium conveyance intervals, control for keeping the induction coil unit 7 turned off during the recording medium intervals, and so on.

(5) Detection of Fixation Belt Breakage, and the Like

An antenna 3 is a magnetic flux detecting means, with which the fixing apparatus 200 is provided to detect the breakage (whether or not a part of fixation belt has torn off) and/or tearing of the fixation belt 2. The antenna 3 is a magnetic flux detecting means, which generates electric current therein as it is exposed to alternating magnetic flux. The antenna 3 is disposed so that it opposes the coil 1 of the induction coil unit 73, with the presence of the fixation belt 2 between the antenna 3 and coil 1. It extends in the width direction of the fixation belt 2, and its length is no less than half the width of the heat generating portion of the fixation belt 2. It is desired, however, that the range across which the loop antenna 3 extends matches roughly the entirety of the track of the widest sheet of recording medium (in terms of the direction perpendicular to recording medium conveyance direction) conveyable through the fixing apparatus 200. Referring to FIG. 4, this antenna 3 is looped in a manner to surround hatched areas A-1 (3-F-1) and A-2 (3-F-2). The material for the antenna 3 is electric wire coated with insulating substance which is resistant to a temperature level of at least 250° C. As alternating magnetic flux moves through the areas A-1 and A-2, alternating voltage and alternating current are induced in the loop antenna 3.

Referring to FIG. 4, as long as the entirety of the loop antenna 3 remains shielded from the magnetic field generated by the coil 1, by the fixation belt 2 having the metallic layer as the electromagnetic inductive heat generating layer, the magnetic field induced by the coil 1 does not reach the loop antenna 3, and therefore, alternating voltage and current do not occur in the loop antenna 3.

Figure 5:
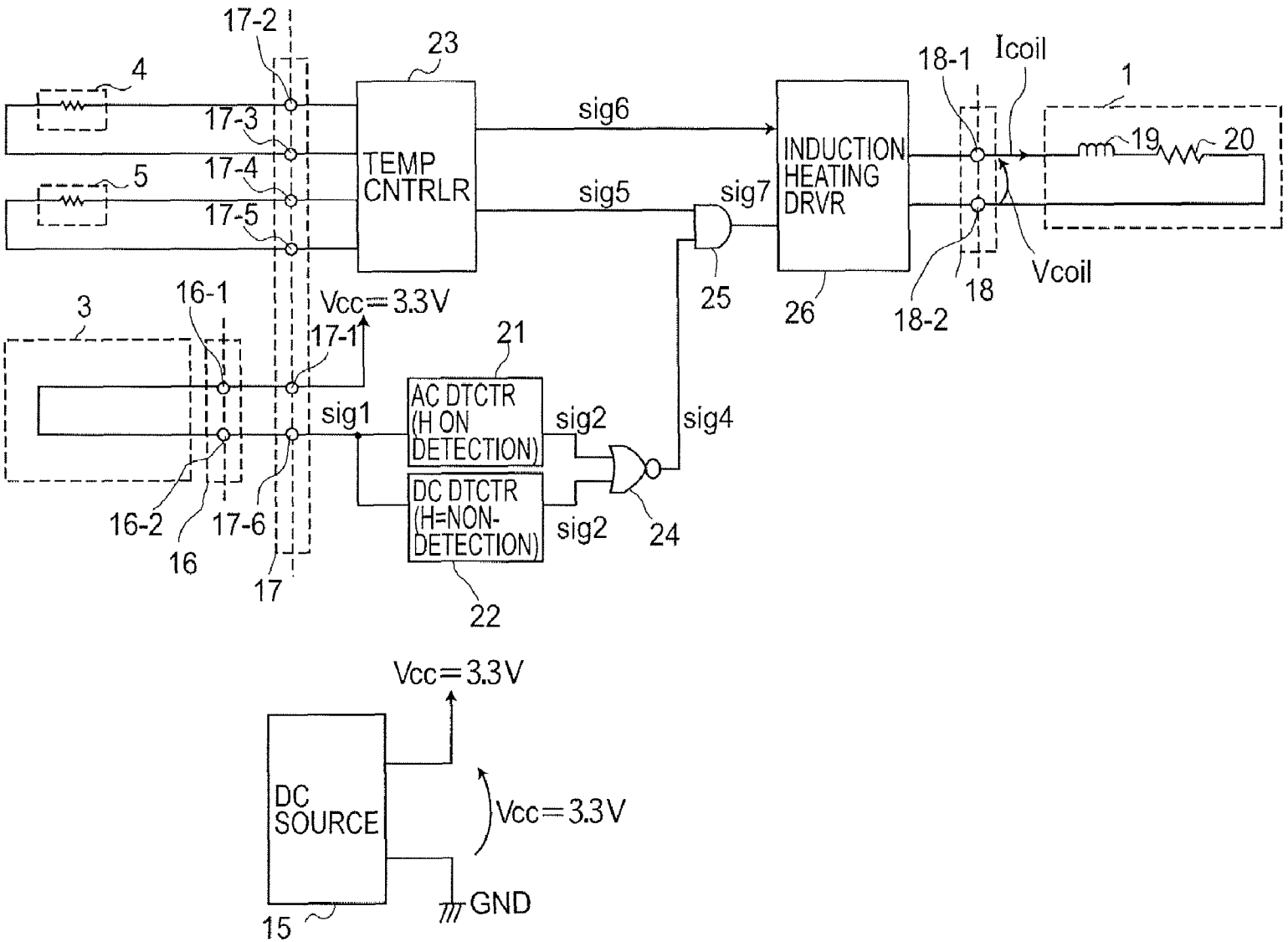
FIG. 5 is a block diagram of the circuit of the control system.

FIG. 5 is a block diagram of the control system which includes the abovementioned loop antenna 3. The temperature control circuit 23 is in contact with the main and subordinate thermistors 4 and 5, through a connector 17 (electrically connective means, which can be disconnected). The temperature control circuit 23 outputs control signals to the induction coil driving circuit 26 (coil driving power source), so that the fixation temperature level detected by the main thermistor 4 is maintained at 200° C., which is the target temperature for the fixation belt 2. Sig 5 is the ON/OFF signal. That is, when Sig 5 is at the high level, it means that the circuit 26 is to be turned on. A signal Sig 6 is the signal for specifying the amount of the electric power to be supplied to drive the coil 1.

The antenna 3 is in connection with the control system through a pair of connectors 16 and 17. The connector 16 has two terminals 16-1 and 16-2. The terminal 16-1 is in connection with a power source 15, of which voltage relative to GND is 3.3 V, and the terminal 16-2 is in connection with an alternating current detection circuit 21 and a direct current detection circuit 22 (Sig 1). This alternating current detection circuit 21 is a means (electric power detecting means) for checking whether or not the voltage which occurs in the antenna 3, or the amount of current which occurs in the antenna 3, exceeds a preset value.

If one or both of the outputs Sig 2 and Sig 3 of these circuits 21 and 22, respectively, become high, the output Sig of NOR 24 of a logic circuit becomes low (output Sig 4 becomes high only when both outputs Sig 2 and Sig3 become low). When the output Sig 4 is low, an OFF signal is given to the induction coil driving 26 (Sig 7), regardless of the status of the ON/OFF signal Sig 5, which the temperature control circuit 23 outputs through AND 25 of the logic circuit.

The NOR 24 and AND 25 constitute a protection circuit (inhibiting means) which interrupts the driving of the coil 1 by the induction coil driving circuit 26 as the power source for driving the coil 1 (interrupt power supply to coil 1), regardless of the belt temperature, in response to the detection by the alternating current detecting means.

The above described antenna 3, alternating current detection circuit 21, and protection circuit, make up the means which detects whether or not a part of the fixation belt 2 has torn off (and/or simply torn), and inhibits power from being supplied to the coil 1.

If Sig 1 inputted into the alternating current detection circuit 21 includes alternating voltage, Sig 2, which is the output signal of the alternating current circuit 21, becomes high in signal level. If the signal 1 contains DC voltage, Sig 3, which is the output signal of the direct current detection circuit 22 becomes low in signal level.

Figure 6:
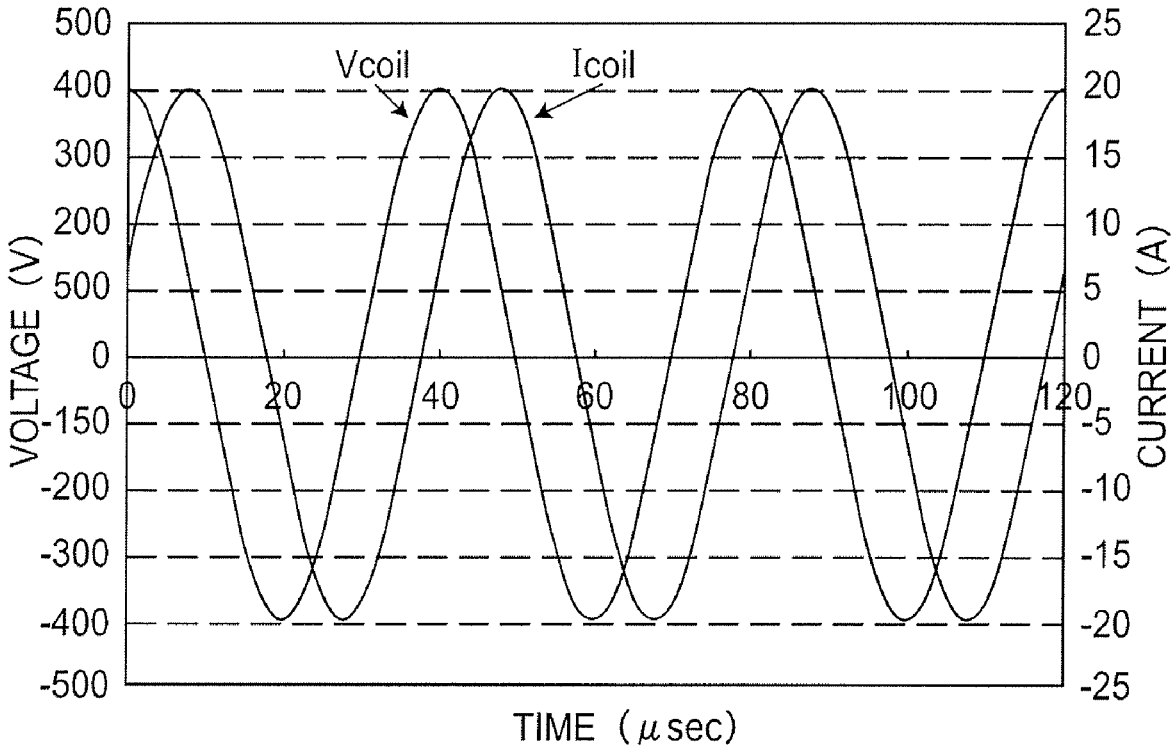
FIG. 6 is a graph showing the waveform of the coil voltage, and the waveform of the coil current.

When the induction coil driving circuit 26 is outputting its maximum amount of power, the voltage between the coil terminal 18-1 and 18-2, and the current which flows between the coil terminal 18-1 and 18-2, are as shown in FIG. 6. That is, the voltage and current are different in phase, and power factor is roughly 0.36. Designated by a referential number 19 is an inductive component, which is 46 μH in inductance. Designated by a referential number 20 is a resistive component, which is 3 Ω in resistance. The combination of these components is equivalent in impedance to the apparatus including the fixation belt 23 when the frequency of the signal is 27 kHz.

Figure 7:
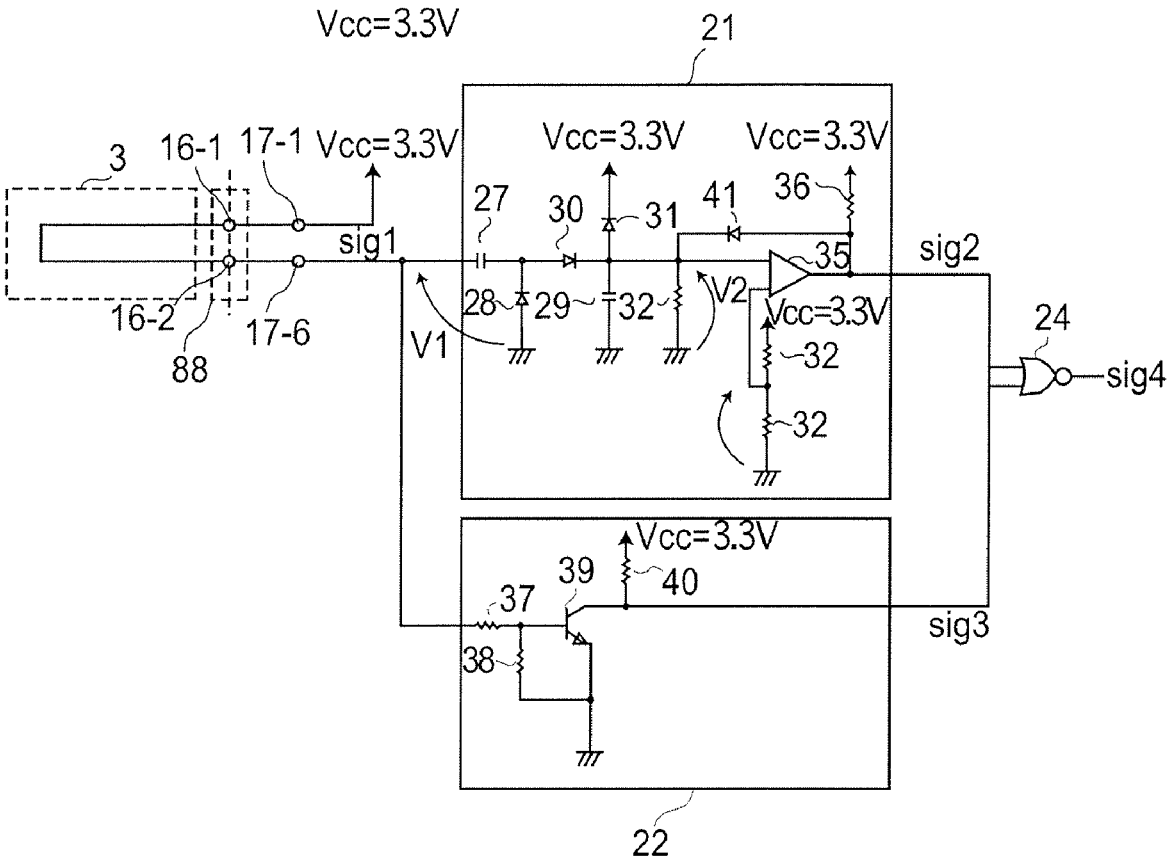
FIG. 7 is a detailed diagram of the combination of the alternating current detection circuit and direct current detection circuit.

FIG. 7 is a detailed diagram of the combination of the alternating current detection circuit 21 and direct current detection circuit 22, shown in FIG. 5, and the constants of the circuits 21 and 22.

(5-1) Normal Condition

The "normal condition" of the fixation belt 2 means that it has not occurred that a part of the fixation belt 2 is torn off and/or simply torn backward in terms of belt movement direction. In other words, it means that the fixation belt 2 is perfect across its entire areas. When the fixation belt 2 is in the normal condition, the entirety of the functional area of the loop antenna 3 is shielded from the coil 1 by the fixation belt 2 having the metallic layer as the layer in which heat is generated by electromagnetic induction, as shown in FIG. 4. Therefore, the magnetic field generated by the coil 1 does not reach the loop antenna 3. Thus, alternating voltage and current do not occur in the loop antenna 3.

Figure 9:
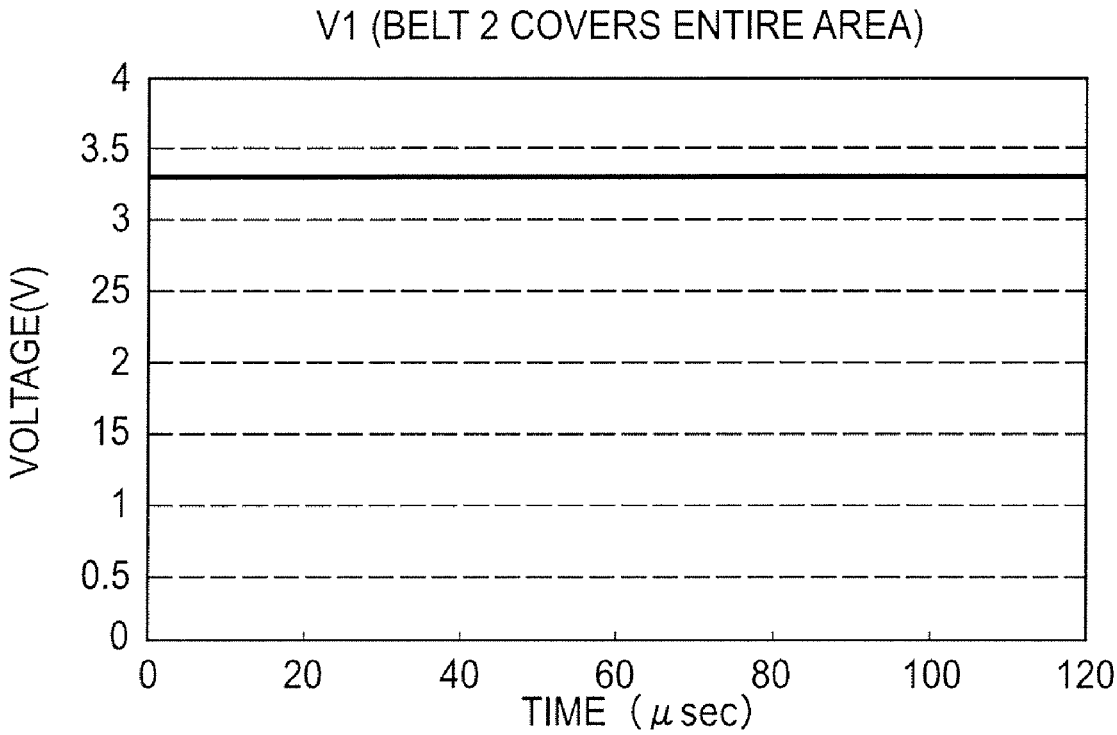
FIG. 9 is a graph showing the waveform of voltage V1 detected when the belt is intact.

Next, the conditions in which the alternating current detection circuit 21 and direct current detection current 22 are when the fixation belt 2 is under the normal condition will be described. The column of FIG. 8, which is named Condition 1, shows the details of the conditions. When the fixing apparatus 200 is in the condition shown in FIGS. 2-4, the connectors 16 and 17 are in the normally connected state, and the voltage V1 of Sig 1 in FIG. 7 is DC voltage and is 3.3 V. The waveform of the voltage V1 is as shown in FIG. 9. The voltage inputted into the positive terminal of a comparator 35 is 0 V, because a condenser 27 blocks direct current voltage.

Figure 10:
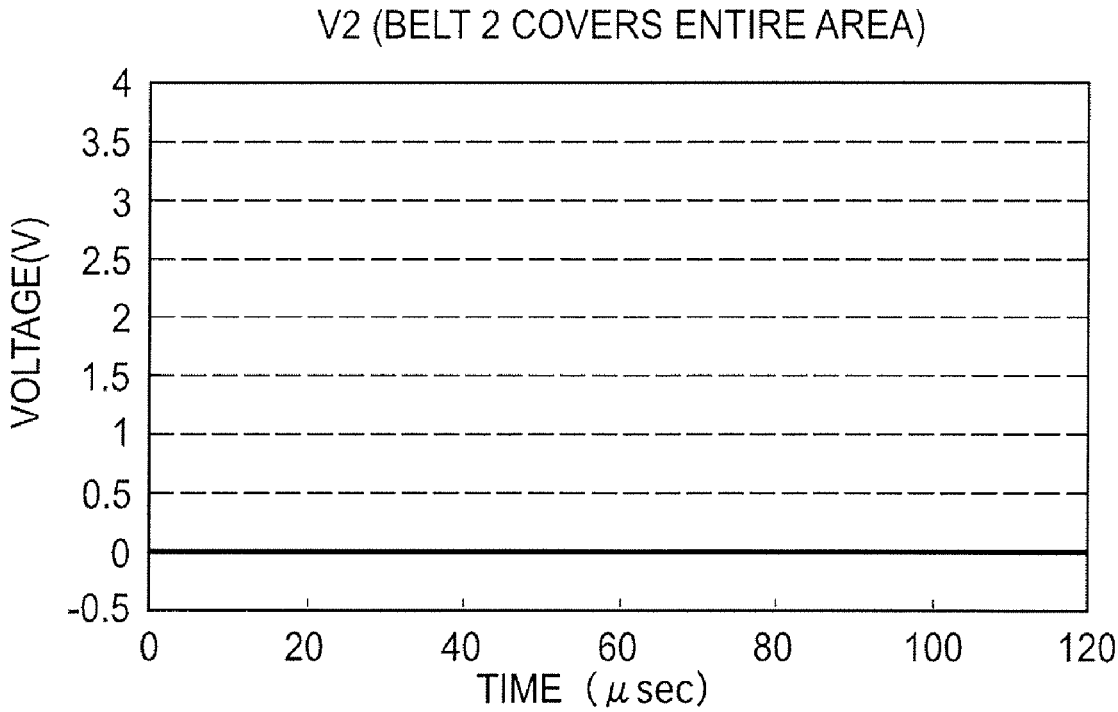
FIG. 10 is a graph showing the waveform of voltage V2 detected when the belt is intact.

The comparator 35 is such a circuit that outputs a high level signal if the input to its positive terminal is greater than the input to its negative terminal. The waveform of the high level signal outputted by the comparator 35 is shown in FIG. 10. In this embodiment, the voltage Vref, which is inputted into the negative terminal of the comparator 35 is set to 0.3 V. Therefore, the comparator 35 outputs a low level signal to Sig 2. Further, DC voltage is applied to the base of a transistor 39 through a resistor 37. Therefore, the transistor 39 turns on, and therefore, the level of Sig 3 at the collector of the transistor 39 becomes low. The induction coil driving circuit 26 is controlled based on Sig 5 and Sig 6 from the temperature control circuit 23.

(5-2) Abnormal Condition (Part of Fixation Belt has Torn Off and/or Torn Backward)

Figure 11:
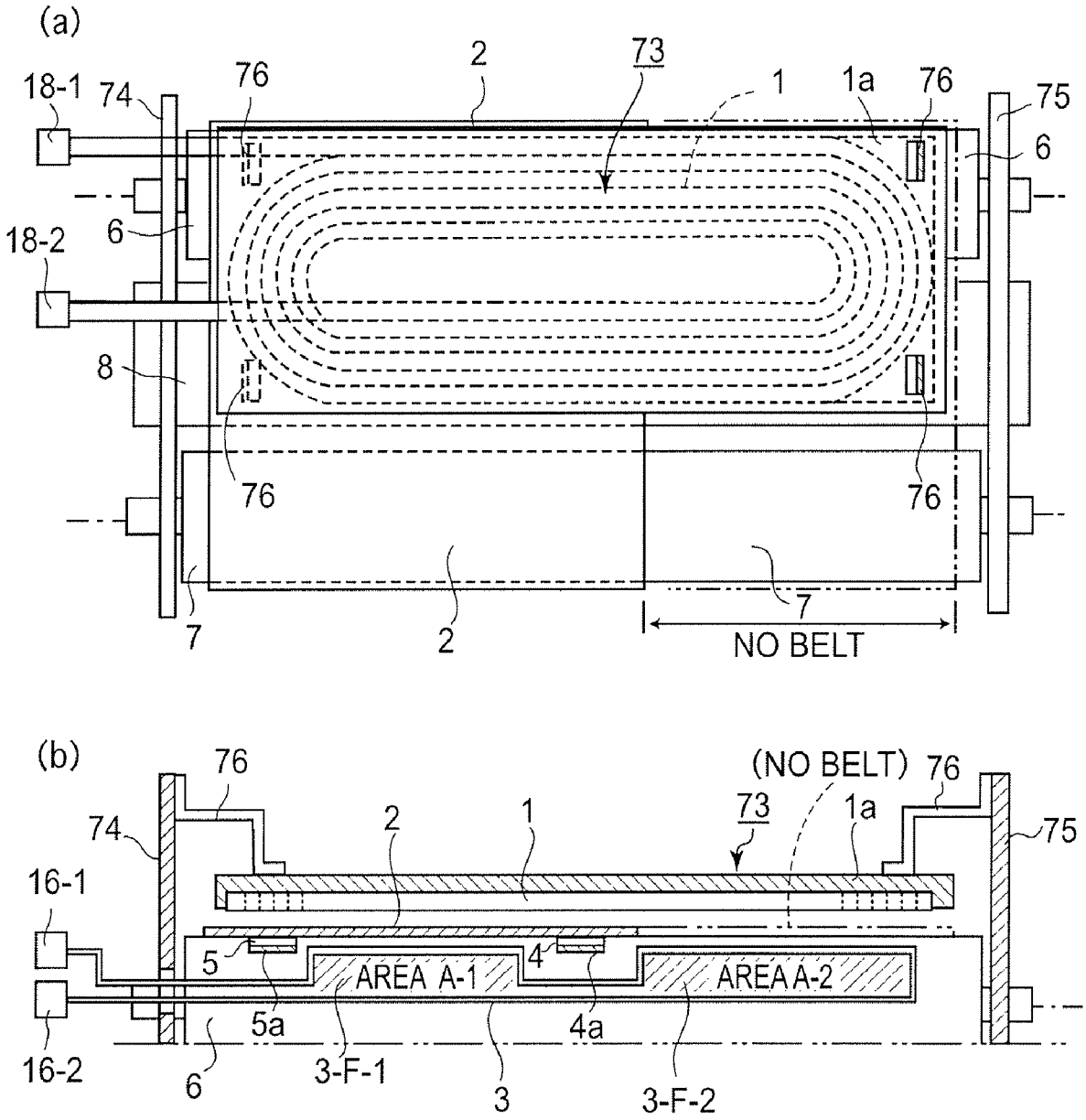
FIG. 11 is a cross-sectional view of the fixing apparatus, along a plane (4)-(4) in FIG. 2, a half (in terms of direction perpendicular to recording medium conveyance direction) of the fixation belt is missing.

FIG. 11 shows the fixing apparatus 200, of which fixation belt 2 has torn off (part of fixation belt 2 is missing). When the fixing apparatus 200 is in this condition, there is the fixation belt 2 (which includes substrate formed of nickel) between the area A-1 of the antenna 3 and the coil 1, preventing thereby the alternating magnetic field which the coil 1 generates, from reaching the area A-1 of the antenna 3. However, there is no fixation belt 2 (of which substrate is formed of nickel) between the area A-2 of the antenna 3 and the coil 1. Therefore, the alternating electric field generated by the coil 1 reaches the area A-2 of the antenna 3. Thus, alternating voltage and current occur between the terminals 16-1 and 16-2 of the antenna 3.

Figure 12:
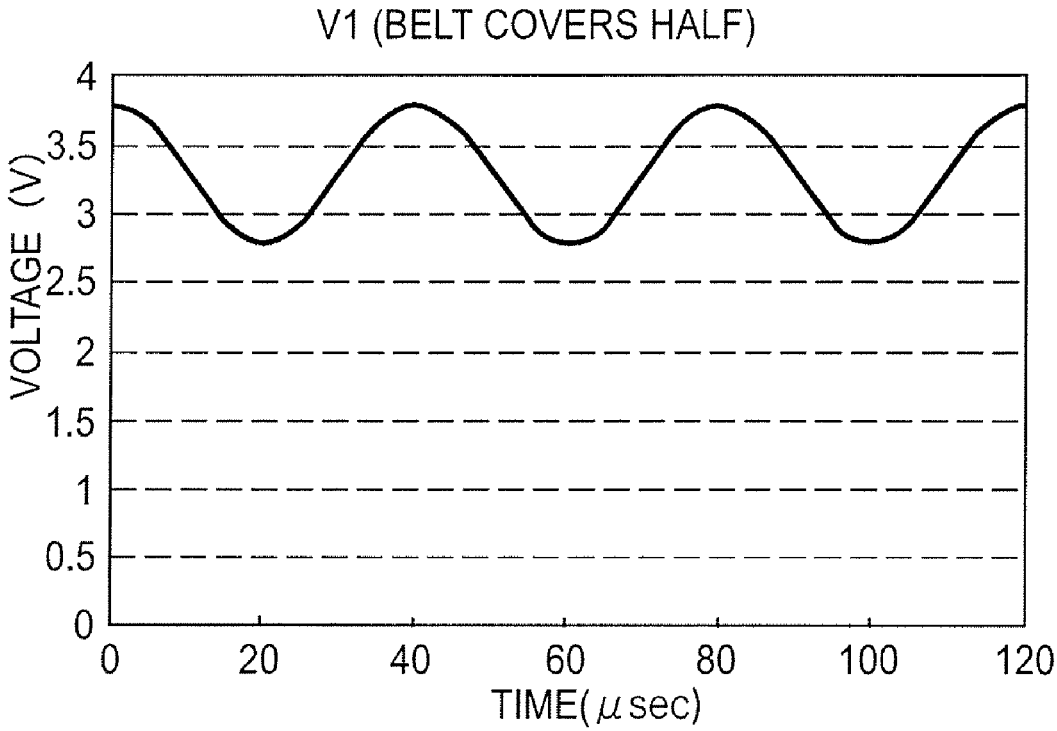
FIG. 12 is a graph showing the waveform of voltage V1 detected when a half (in terms of direction perpendicular to recording medium conveyance direction) of the fixation belt is missing.
Figure 13:
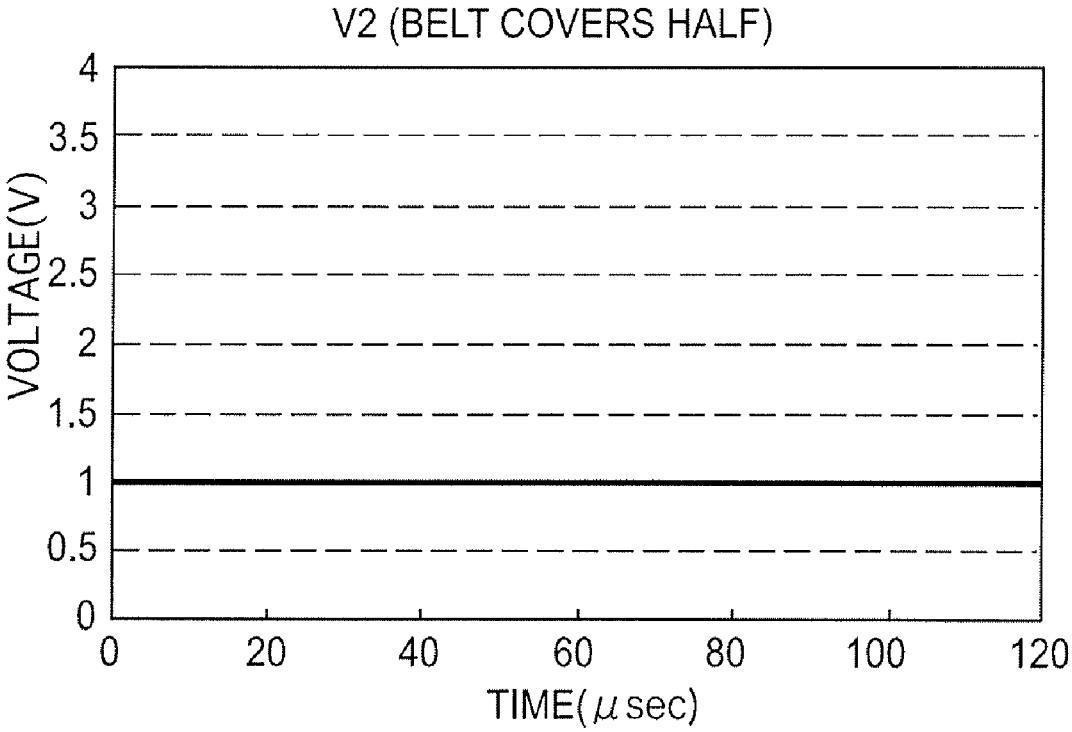
FIG. 13 is a graph showing the waveform of voltage V2 detected when a half (in terms of direction perpendicular to recording medium conveyance direction) of the fixation belt is missing.

If roughly half the fixation belt 2, in terms of its width direction, is missing, and the connecter 17 is in the normally connected state, the magnetic field generated by the coil 1 reaches the antenna 3, generating alternating voltage, of which amplitude is 1 V, in the antenna 3. Thus, the combination of 3.3 V of DC voltage, and the AC voltage, of which amplitude is 1 V, appears in Sig 1. The waveform of this voltage is shown in FIG. 12. Further, in this case, Sig 1 is alternating voltage, and therefore, current flows through condenser 27 (FIG. 7). This alternating current is separated by the diodes 28 and 30, based on the direction in which it flows, and the condenser 29 is charged. The condenser 29 discharges this charge through a resistor 32. However, the time constant of this discharge is overwhelmingly longer than the period of 27 kHz. Therefore, the discharge becomes roughly 1 V of DC voltage. The waveform of this DC voltage is shown in FIG. 13. Also in this case, the voltages on the positive and negative sides of the comparator 35 are 1 V and 0.3 V, respectively. Thus, the voltage of the comparator 35 is at the high level, and the output Sig 4 of NOR 24 is at the low level. Because Sig 7 is at the low level regardless of the state of Sigs 5 and 6, the induction coil driving circuit 26 functions to stop the driving of the coil 1.

If the driving of the coil 1 is stopped by the function of the protection circuit 21 and 22 as described above, the control circuit 50 (FIG. 1) functions as the inhibiting means for stopping the image forming operation of the image forming apparatus, including the fixing apparatus 200, as quickly as possible. Then, it displays a message, such that a damage (damages including tearing) has occurred, or that the connecter 17 becomes disconnected, as will be described later, and prompts a user to take an appropriate measure.

Therefore, it does not occur that the image forming operation is continued even though the fixation belt 2 has partially or entirely torn off, more specifically, the entirety or a part of the fixation belt 2 is missing (including being partially torn); it does not occur that the coil 1 is wastefully driven.

Further, in order to prevent the output of the comparator 35 from reverting to the low level, the diode 41 latches the high level of the output of the comparator 35 to the positive input level of the comparator 35. This state can be cleared by turning off the DC power source 15, of which voltage is 3.3 V, and then, turning it on again.

Condition 3 in FIG. 8 is a condition that the connector 17 has become disconnected. In this case, Sig 1 is 0 V, and therefore, the transistor 39 is off, and Sig 3 is high because of 3.3 V supplied through a resistor 40. Therefore, Sig 4, which is the output signal of NOR 24 is at low level. Further, Sig 7 is at the low level regardless of the status (level) of Sig 5 and Sig 6 outputted from the temperature control circuit 23. Therefore, the induction coil driving circuit 26 functions to stop the driving of the coil 1. The control circuit 50 (FIG. 1) stops the image forming operation of the image forming apparatus, inclusive of the fixing apparatus 200, as quickly as possible.

Therefore, it does not occur that a printing operation is continued even though the connector 17 is not in connection with the temperature control circuit 23, that is, even through the thermistors 4 and 5 are not in connection with the temperature control circuit 23. In other words, it does not occur that a printing operation is continued even though the driving the coil 1 is being driven with no connection between the thermistors 4 and 5, and the temperature control circuit 23.

Therefore, it does not occur that because the connectors of the main thermistor 4 are disengaged (have become disengaged), that is, because the main thermistor 4 is not in connection with the temperature control circuit 23, the temperature of the belt 2 is erroneously detected (it is determined to be lower than target level). Therefore, it does not occur that the belt 2 is heated to a temperature level higher than 200° C.

Next, the values, to which the amount by which the belt 2 has torn or torn off must increase before it is detected that the belt 2 has torn or torn off when the damage to the belt 2 has been gradually increasing, will be described in detail.

Figure 14:
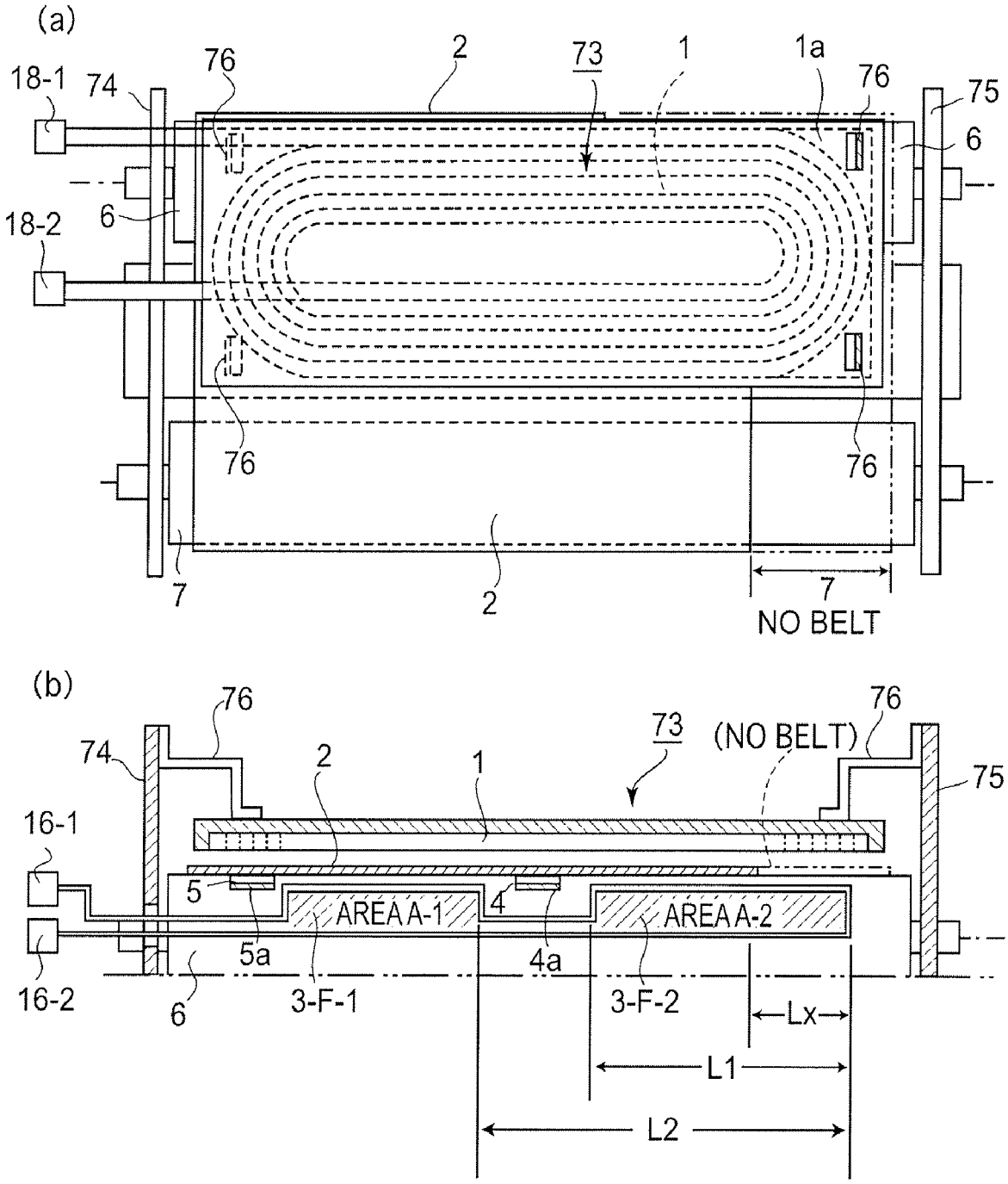
FIG. 14 is a cross-sectional view of the fixing apparatus, along a plane (4)-(4) in FIG. 2, in which one half of its belt is missing.
Figure 15:
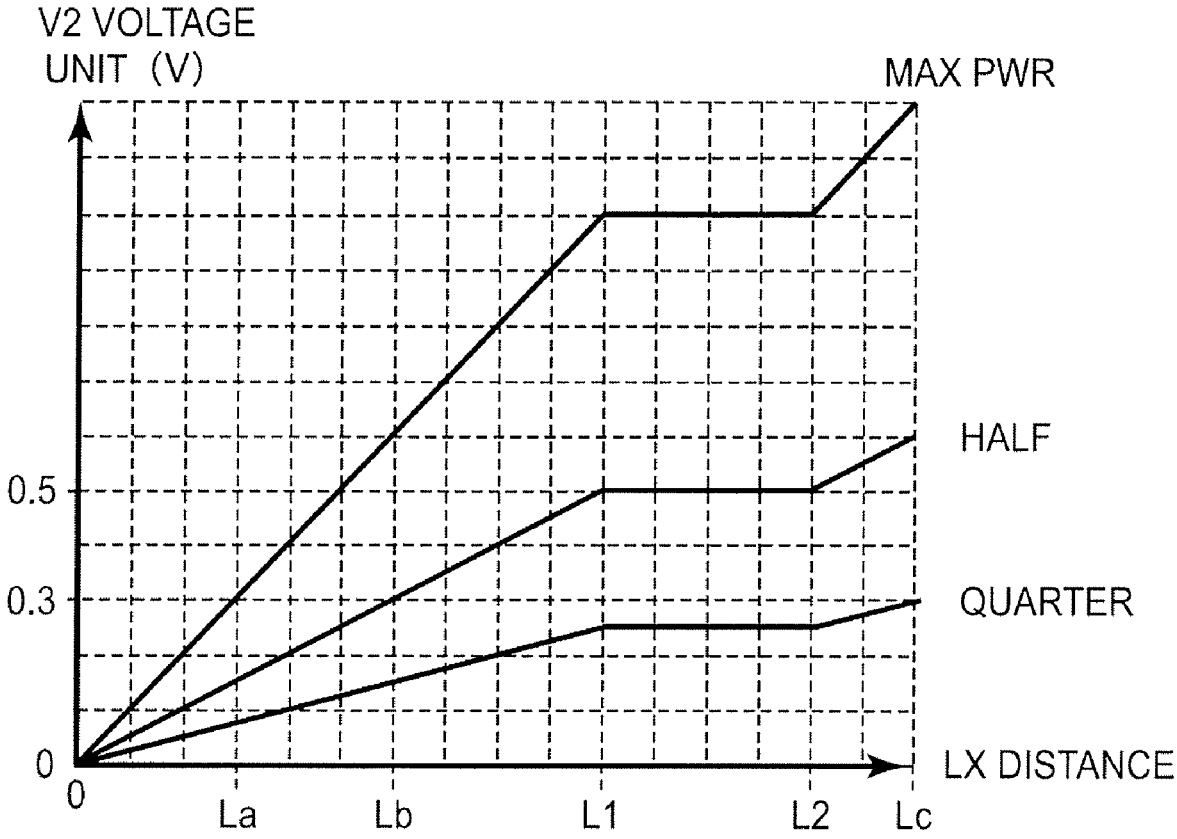
FIG. 15 is a graph showing the relationship between the amount of belt breakage and voltage V2.

FIG. 14 shows the fixing apparatus 200, in which a part of the edge portion of fixation belt is missing (has torn off). In the drawing, a referential character Lx stands for the distance between the right-hand end of the antenna 3 and the right-hand edge of the belt 2, and this distance Lx is used as the amount by which the belt 2 is missing in terms of its width direction. FIG. 15 shows the relationship between the changes in the distance Lx and the changes in the detected voltage V2. The reason why three lines extend from the origin is that this relationship is affected by the amount of power supplied to drive the coil 1. That is, the three lines represent the relationship between the Lx and V2 which results when the amount of power supplied to drive the coil 1 is largest, is half the largest amount, and one quarter the largest amount, one for one; they show that the detected output voltage V2 is proportional to the amount of power supplied to drive the induction coil 1. More specifically, when Lx is in a range of 0-L1, the detected voltage V2 increases in proportion to Lx. When Lx is in a range of L1-L2, V2 does not change, because the loop antenna 3 is shaped to make room for the thermistor 4, and therefore, the portion of the antenna 3, which corresponds to the position of the thermistor 4, is negligibly small in size. When Lx is greater than L2, the detected voltage V2 increases, because the portion of the antenna 3, which corresponds to Lx, is substantial in size.

As described above, the detected voltage V2 is compared to 0.3 V by the comparator 35. Therefore, if Lx becomes larger than La, in FIG. 15, while the coil 1 is driven by the maximum amount of power, the comparator 35 reverses in function, and functions to stop the driving of the coil1, as it does if a half of the belt 2, in terms of its width direction, becomes critically damaged or completely lost while the coil 1 is driven with the maximum amount of power.

Similarly, if Lx becomes larger than Lb while the coil 1 is driven with half the maximum amount of power, the comparator 35 reverses in function, functioning therefore to stop the driving of the coil 1.

Further, if Lx becomes larger than Lc while the coil 1 is driven with half the maximum amount of power, the comparator 35 reverses in function, functioning therefore to stop the driving of the coil 1.

Embodiment 2

Figure 16:
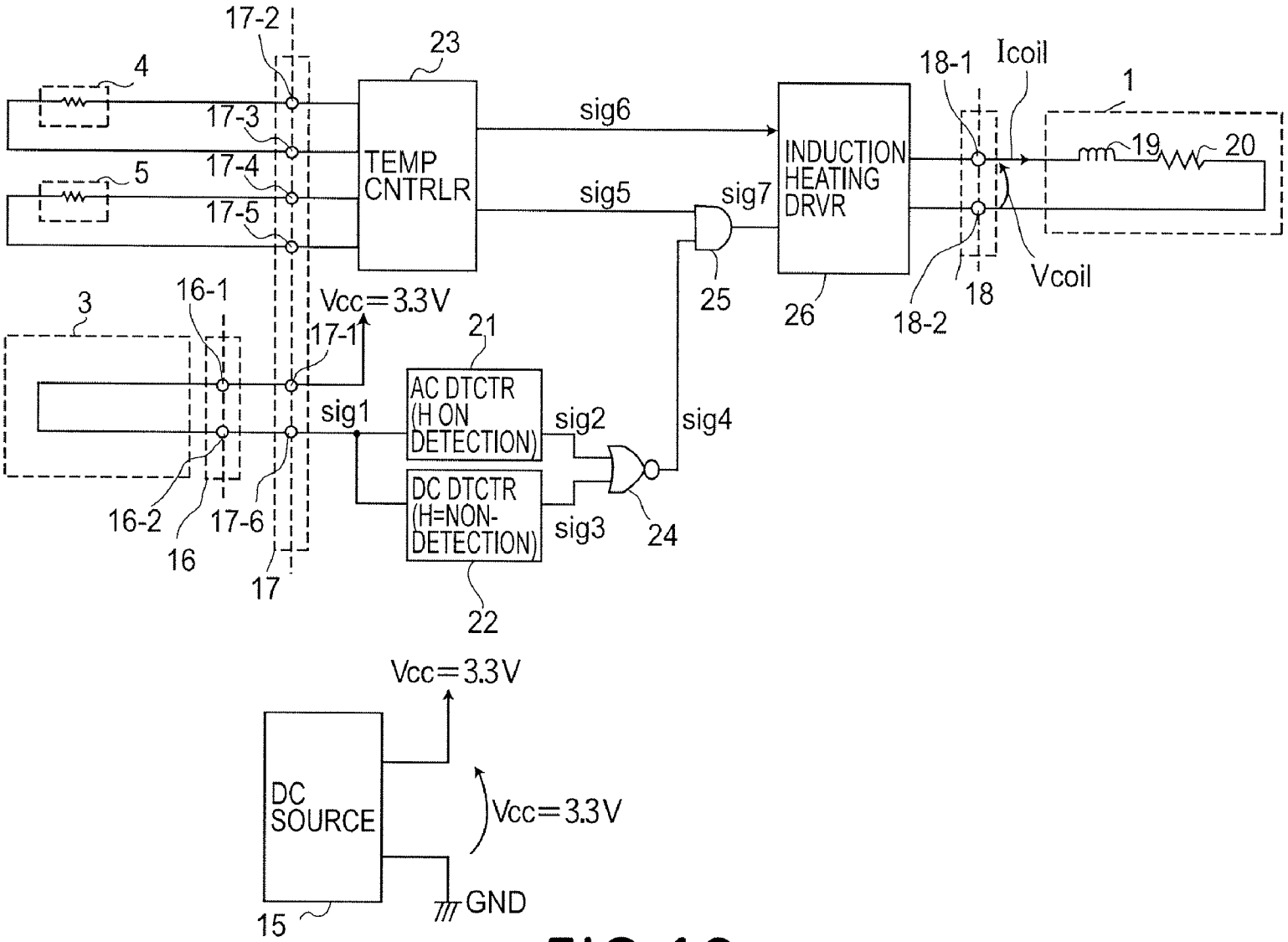
FIG. 16 is a block diagram of the circuit of the control system of the fixing apparatus in the second embodiment.

In the first embodiment, in order for the belt damage to be detected to stop the driving of the coil 1, the amount of the belt damage has to be inversely proportional to the amount of power used to drive the coil 1. Referring to FIG. 16, in this embodiment, Sig 6, which sets the amount by which power is supplied to drive the coil 1, is inputted into the alternating current detection circuit 21.

Figure 18:
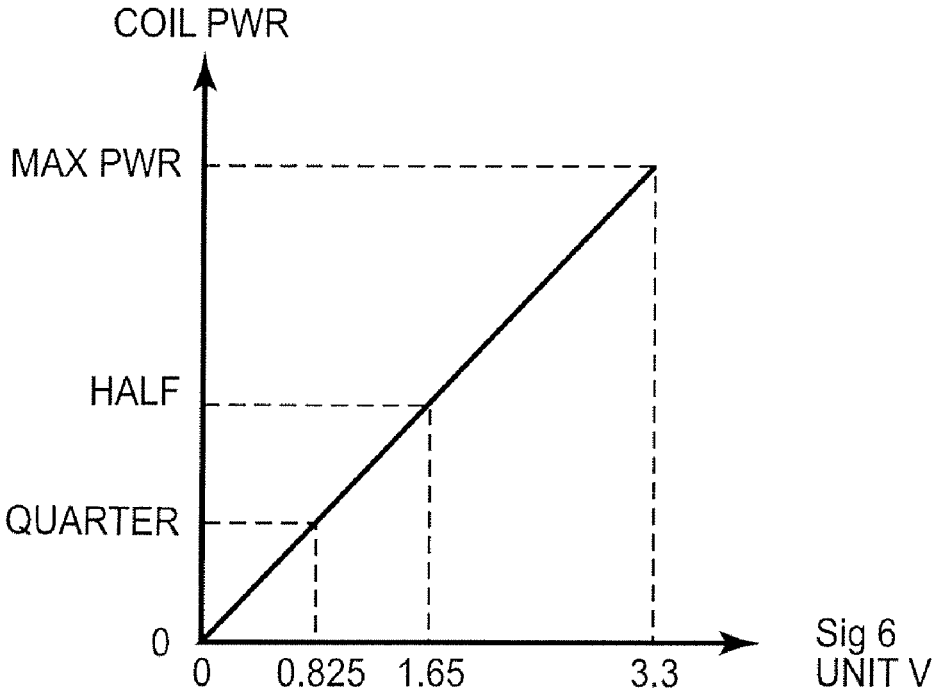
FIG. 18 is a graph showing the relationship between Sig 6 and the amount of electric power supplied to drive the coil.
Figure 17:
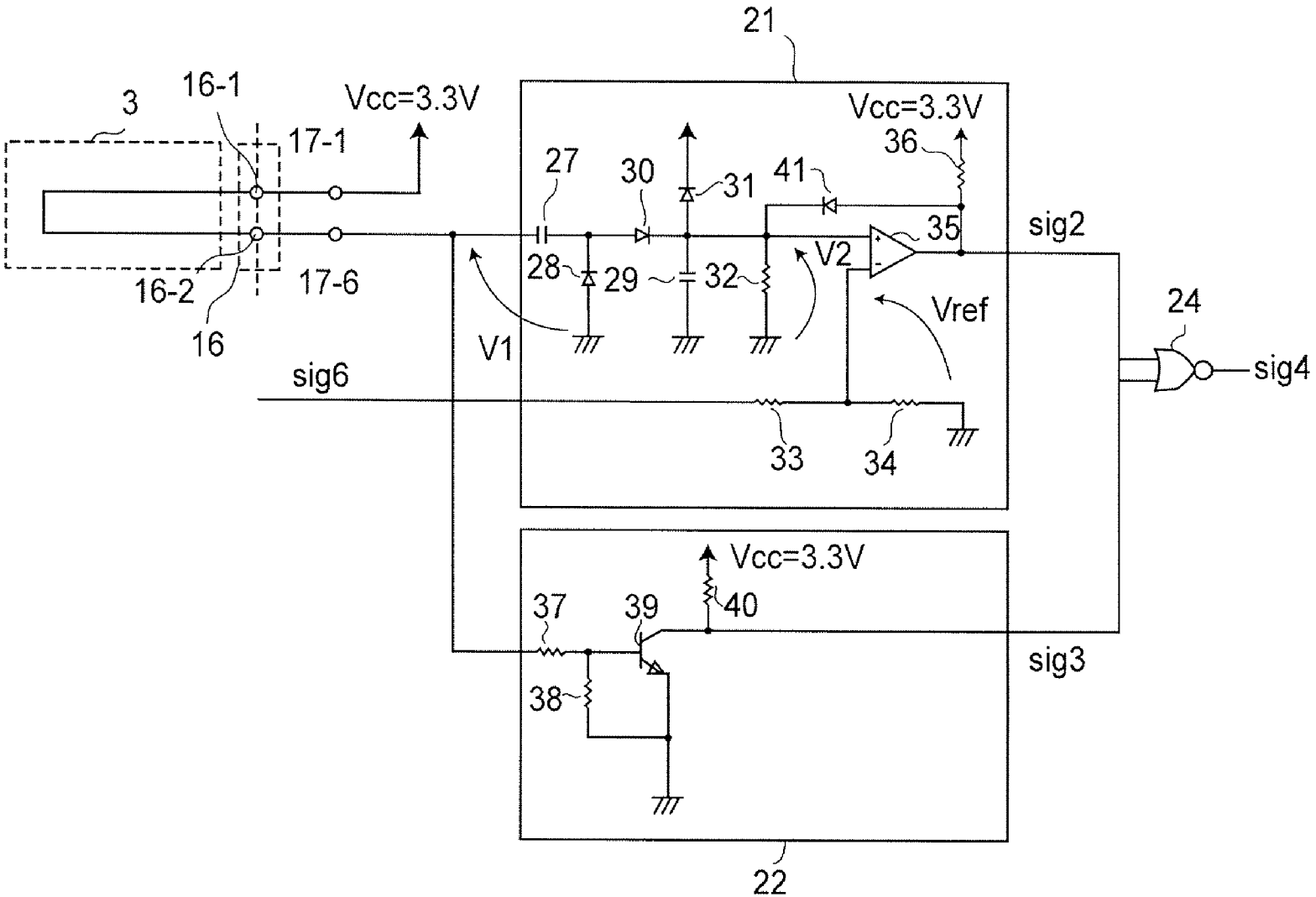
FIG. 17 is detailed diagram of the combination of the alternating current detection circuit and direct current detection circuit.

Referring to FIG. 17, Sig 6 is used as the voltage separated by the voltage divider circuit made up of resistors 33 and 34 to generate Vref which is to be inputted into the negative input terminal of the comparator 35. The relationship between Sig 6 and the amount of power used to drive the coil 1 is shown in FIG. 18.

Figure 19:
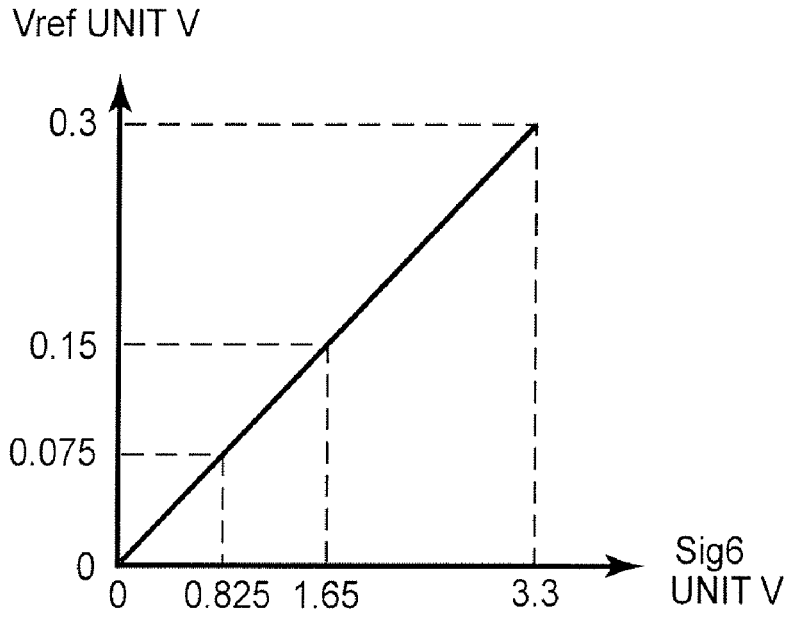
FIG. 19 is a graph showing the relationship between Sig 6 and referential voltage Vrf.

FIG. 19 shows the relationship between Vref, that is, the voltage which is obtained by dividing Sig 6 by the voltage dividing circuit made up of the resistors 33 and 34 and is inputted into the negative input terminal of the comparator 35, and Sig 6.

Figure 20:
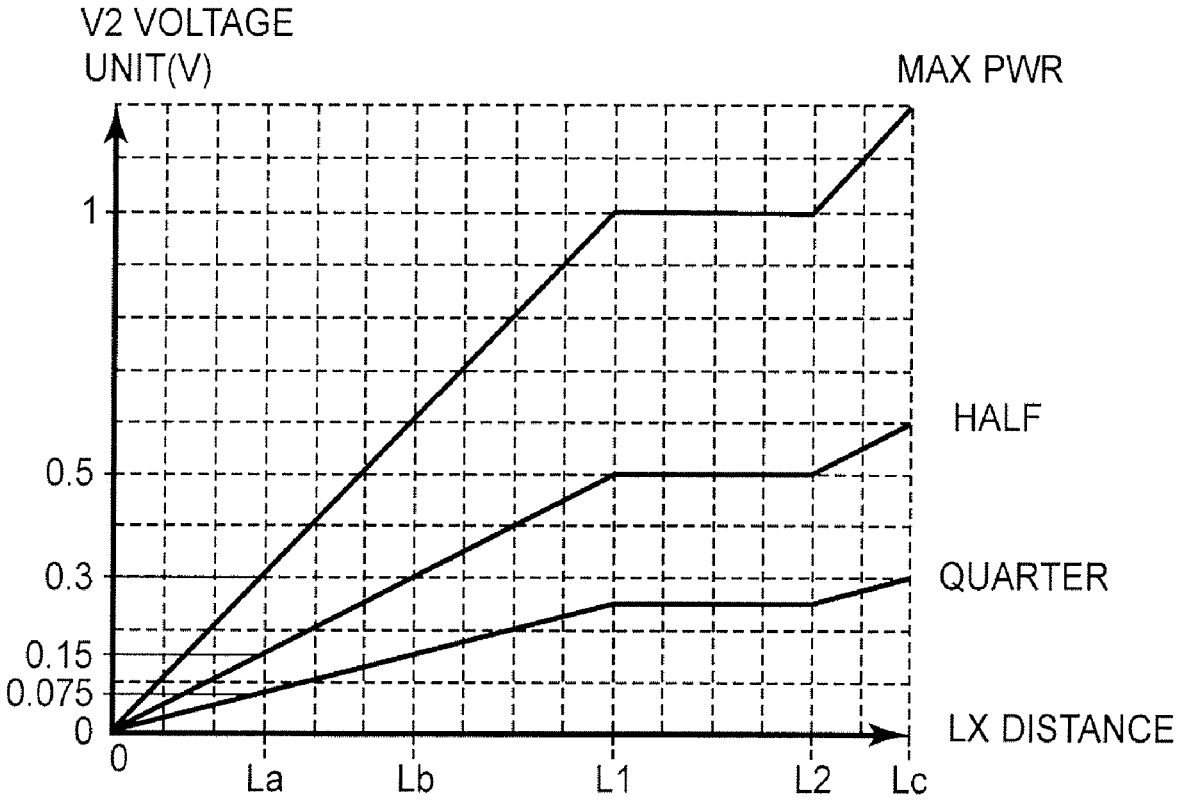
FIG. 20 is a graph showing the relationship between the amount of belt breakage and Voltage V2.

Therefore, Vref, that is, the voltage inputted into the negative input terminal of the comparator 35, is set in proportion to the amount of power supplied to the coil 1. For example, when the amount of power supplied to the coil 1 is the maximum, Vref is 3.3 V. When it is half the maximum amount, Vref is 1.65 V. Further, when it is quarter the maximum amount, Vref is 0.825 V. Transposing these voltage values onto the vertical axis of FIG. 15 (which is for describing first embodiment) yields FIG. 20. That is, even when the amount of power supplied to drive the coil 1 is half or quarter the maximum amount, as Lx becomes larger than La, the output of the comparator 35 changes from the low level to the high level. That is, the amount by which the belt 2 must break in order for the breakage of the belt 2 to be detected, remains the same regardless of the amount of power supplied to drive the coil 1.

While the invention has been described with reference to the structures disclosed herein, it is not confined to the details set forth, and this application is intended to cover such modifications or changes as may come within the purposes of the improvements or the scope of the following claims.

This application claims priority from Japanese Patent Application No. 159653/2006 filed Jun. 8, 2006 which is hereby incorporated by reference.

What is claimed is:

1. An image heating apparatus comprising:

a coil for generating a magnetic flux;

an endless belt having an electroconductive layer for generating heat by the magnetic flux from said coil, wherein a recording material carrying an image is heated by heat of said endless belt;

a magnetic flux detecting member disposed opposed to said coil with said belt interposed therebetween and capable of detecting the magnetic flux from said coil, said magnetic flux detecting member disposed to corresponding to substantially an entire area of a feeding region for a maximum size recording material with respect to a widthwise direction of the recording material; and prohibition means for prohibiting electric power supply to said coil when an amount of magnetic flux detected by said magnetic flux detecting member reaches a predetermined amount.

2. An apparatus according to claim 1, wherein said magnetic flux detecting member includes an antenna for generating a voltage or current in accordance with said coil.

3. An apparatus according to claim 2, further comprising a conduction detecting portion for detecting electrical conduction of said antenna, wherein said prohibition means prohibits the electric power supply to said coil when said conduction detecting portion detects non-conduction of said antenna.

4. An apparatus according to claim 1, further comprising a temperature detecting member for detecting a temperature of said endless belt, and a control unit for controlling the electric power supply to said coil to maintain a temperature of said endless belt at a target temperature on the basis of a result of detection of said temperature detecting member, wherein said prohibition means prohibits the electric power supply to said coil when an amount of the magnetic flux detected by said magnetic flux detecting member reaches a predetermined amount during a period in which said control unit normally effects its temperature control to provide the temperature of said endless belt within a predetermined range including the target temperature.

* * * * *